US008956792B2

(12) United States Patent
Okuda et al.

(10) Patent No.: US 8,956,792 B2
(45) Date of Patent: Feb. 17, 2015

(54) ELECTROPHOTOGRAPHIC PHOTOSENSITIVE MEMBER, PROCESS CARTRIDGE, ELECTROPHOTOGRAPHIC APPARATUS, AND METHOD OF PRODUCING ELECTROPHOTOGRAPHIC PHOTOSENSITIVE MEMBER

(75) Inventors: Atsushi Okuda, Yokohama (JP); Harunobu Ogaki, Suntou-gun (JP); Kazunori Noguchi, Suntou-gun (JP); Takashi Anezaki, Hiratsuka (JP); Kazuhisa Shida, Mishima (JP); Shio Murai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/443,701

(22) Filed: Apr. 10, 2012

(65) Prior Publication Data

US 2012/0263494 A1 Oct. 18, 2012

(30) Foreign Application Priority Data

Apr. 14, 2011 (WO) ..... PCT/JP2011/059248

(51) Int. Cl.
*G03G 5/05* (2006.01)
*G03G 5/147* (2006.01)

(52) U.S. Cl.
CPC ..... *G03G 5/0578* (2013.01); *G03G 5/0564* (2013.01); *G03G 5/14756* (2013.01); *G03G 5/14773* (2013.01)
USPC ..... 430/58.8; 430/58.2; 430/59.6; 430/58.5; 430/65; 430/58.75; 430/58.85; 399/159

(58) Field of Classification Search
USPC ..... 430/59.6, 58.8, 58.2, 58.5, 58.65, 430/58.75, 58.85; 399/159
See application file for complete search history.

(56) References Cited

U.S. PATENT DOCUMENTS 5,486,439 A * 1/1996 Sakakibara et al. ..... 430/58.45
2010/0092208 A1* 4/2010 Ogaki et al. ..... 399/111

FOREIGN PATENT DOCUMENTS

JP 6-019336 A 1/1994
JP 06019151 * 1/1994
JP 06-075415 A 3/1994
JP 6-332212 A 12/1994
JP 2007-199688 A 8/2007
JP 2008-145764 A 6/2008
WO 2010/008095 A 1/2010

* cited by examiner

*Primary Examiner* — Peter Vajda
*Assistant Examiner* — Olatunji Godo
(74) *Attorney, Agent, or Firm* — Canon U.S.A., Inc. IP Division

(57) ABSTRACT

Provided is an electrophotographic photosensitive member which is excellent in terms of both continuous reduction of contact stress with contact members and the like and potential stability during repeated use. A charge transport layer which serves as a surface layer of an electrophotographic photosensitive member has a matrix-domain structure including a matrix containing a component [β] (polycarbonate resin D having a specific repeating structural unit) and a charge-transporting substance and domains containing a component [α] (polycarbonate resin A having a repeating structural unit including a specific siloxane moiety).

6 Claims, 1 Drawing Sheet

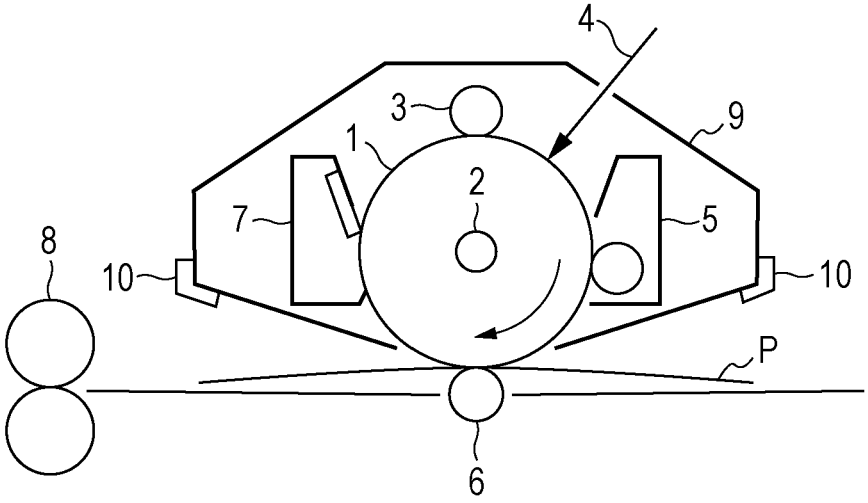
4
3
9
1
2
7
5
8
10
10
P
6

ELECTROPHOTOGRAPHIC PHOTOSENSITIVE MEMBER, PROCESS CARTRIDGE, ELECTROPHOTOGRAPHIC APPARATUS, AND METHOD OF PRODUCING ELECTROPHOTOGRAPHIC PHOTOSENSITIVE MEMBER

TECHNICAL FIELD

The present invention relates to an electrophotographic photosensitive member, a process cartridge, an electrophotographic apparatus, and a method of producing an electrophotographic photosensitive member.

BACKGROUND ART

As an electrophotographic photosensitive member installed in an electrophotographic apparatus, organic electrophotographic photosensitive members containing an organic photoconductive substance (charge-generating substance) (hereinafter, may be referred to as "electrophotographic photosensitive members") have been used. In the electrophotographic process, various members, such as a developer, a charging member, a cleaning blade, paper, and a transfer member, (hereinafter, may also be referred to as "contact members and the like") come into contact with the surface of an electrophotographic photosensitive member. Therefore, in the electrophotographic photosensitive member, it is required to reduce the occurrence of image degradation caused by contact stress with these contact members and the like. In particular, as the durability of electrophotographic photosensitive members has been improved in recent years, the electrophotographic photosensitive members have been required to maintain the effect of reducing image degradation caused by contact stress.

Regarding continuous reduction of contact stress, PTL 1 has proposed a method in which, using a siloxane resin having a siloxane structure incorporated into its molecular chain, a matrix-domain structure is formed in a surface layer. The proposal shows that, by using a polyester resin into which a specific siloxane structure is incorporated, it is possible to achieve both continuous reduction of contact stress and potential stability (suppression of variation) when the electrophotographic photosensitive member is repeatedly used.

On the other hand, a proposal has been made in which a siloxane-modified resin having a siloxane structure in its molecular chain is incorporated into a surface layer of an electrophotographic photosensitive member. PTL 2 and PTL 3 each have proposed an electrophotographic photosensitive member containing a polycarbonate resin into which a siloxane structure having a specific structure is incorporated, and have reported effects of improvement in resistance to solvent cracking due to a mold-releasing action and lubricity of the surface of the photosensitive member at the beginning of use.

CITATION LIST

Patent Literature

PTL 1 International Publication No. WO2010/008095
PTL 2 Japanese Patent Laid-Open No. 06-075415
PTL 3 Japanese Patent Laid-Open No. 2007-199688

In the electrophotographic photosensitive member disclosed in PTL 1, both continuous reduction of contact stress and potential stability during repeated use are achieved. However, as a result of study by the present inventors, it has been found that further improvement is necessary. That is, an attempt has been made in order to obtain the same effect in a polycarbonate resin into which a specific siloxane structure is incorporated on the basis of the finding in PTL 1, but it has been difficult to form an efficient matrix-domain structure in a surface layer in the case of the polycarbonate resin. It has been found that it is necessary to improve both continuous reduction of contact stress and potential stability when the electrophotographic photosensitive member is repeatedly used.

PTL 2 discloses an electrophotographic photosensitive member having a surface layer which includes a mixture of a polycarbonate resin having a siloxane structure having a specific structure incorporated into the main chain of the resin and a copolymerized polycarbonate resin having a specific structure without a siloxane structure. It is shown that, in the electrophotographic photosensitive member of Cited Document 2, resistance to solvent cracking and resistance to toner adhesion are improved. However, in the electrophotographic photosensitive member of PTL 2, the effect of continuous reduction of contact stress has been insufficient. Furthermore, PTL 3 discloses an electrophotographic photosensitive member having a surface layer which includes a mixture of a polycarbonate resin having a siloxane structure having a specific structure incorporated into the main chain and the end of the resin and a polycarbonate resin without a siloxane structure. It is shown that lubricity is improved at the beginning of use. However, in the electrophotographic photosensitive member described in PTL 3, the effect of continuous reduction of contact stress has been insufficient. The reason for this is believed to be that since the resin into which the siloxane structure is incorporated according to PTL 3 has high surface migration, the effect of continuously reducing contact stress is low.

According to aspects of the invention, it is an object to provide an electrophotographic photosensitive member which is excellent in terms of both continuous reduction of contact stress with contact members and the like and potential stability during repeated use. According to another aspect, it is an object to provide a process cartridge and an electrophotographic apparatus each including the electrophotographic photosensitive member. According to yet another aspect, it is an object to provide a method of producing an electrophotographic photosensitive member in which the electrophotographic photosensitive member described above is produced.

SUMMARY OF INVENTION

The objects described above may be achieved according to aspects of the present invention described below. Aspects of the present invention relate to an electrophotographic photosensitive member including a support, a charge generation layer provided on the support, and a charge transport layer provided on the charge generation layer, the charge transport layer serving as a surface layer, characterized in that the charge transport layer has a matrix-domain structure including a matrix containing a component [β] described below and a charge-transporting substance and domains containing a component [α] described below.

The component [α] is a polycarbonate resin A which has a repeating structural unit represented by the formula (A) below, a repeating structural unit represented by the formula (B) below, and a repeating structural unit represented by the formula (C) below and in which the content of a siloxane moiety is 5% to 40% by mass, the content of the repeating structural unit represented by the formula (B) below is 10% to 30% by mass, and the content of the repeating structural unit represented by the formula (C) below is 25% to 85% by mass.

(A)

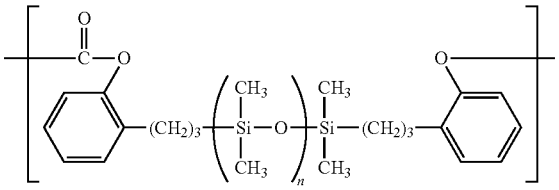

In the formula (A), n represents the number of repetitions of a structure within the brackets, and the average value of n for the polycarbonate resin A is 20 to 60.

(B)

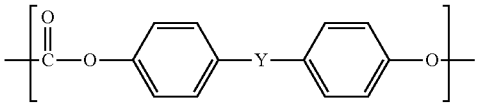

In the formula (B), Y represents an oxygen atom or a sulfur atom.

(C)

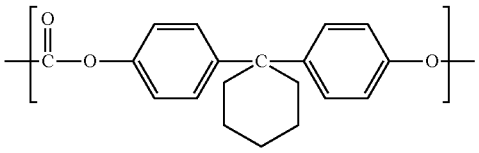

The component [β] is a polycarbonate resin D which has a repeating structural unit represented by the formula (D) below.

(D)

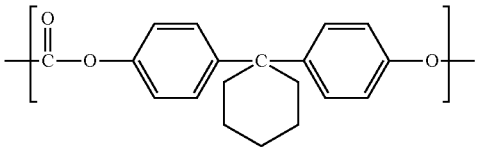

Furthermore, aspects of the present invention relate to a process cartridge which integrally holds the electrophotographic photosensitive member and at least one means selected from the group consisting of charging means, developing means, transferring means, and cleaning means, and which is detachably mountable to a main body of an electrophotographic apparatus.

Furthermore, aspects of the present invention relate to an electrophotographic apparatus which includes the electrophotographic photosensitive member, charging means, exposing means, developing means, and transferring means.

Furthermore, aspects of the present invention relate to a method of producing the electrophotographic photosensitive member, the method being characterized by including a step of applying a charge transport layer coating solution containing the components [α] and [β] and a charge-transporting substance onto the charge generation layer, followed by drying to form the charge transport layer.

Further features of the present invention will become apparent from the following description of exemplary embodiments with reference to the attached drawings.

BRIEF DESCRIPTION OF DRAWINGS

FIGURE is a view showing an example of a schematic structure of an electrophotographic apparatus provided with a process cartridge including an electrophotographic photosensitive member according to aspects of the present invention.

DESCRIPTION OF EMBODIMENTS

An electrophotographic photosensitive member according to aspects of the present invention includes, as described above, a support, a charge generation layer provided on the support, and a charge transport layer provided on the charge generation layer, the charge transport layer serving as a surface layer, in which the charge transport layer has a matrix-domain structure including a matrix containing a component [β] and a charge-transporting substance, and domains containing a component [α].

When the matrix-domain structure according to aspects of the present invention is compared to a "sea-island structure", the matrix corresponds to the sea and the domains correspond to the islands. The domains containing the component [α] constitute a particulate (island) structure formed in the matrix containing the component [β] and the charge-transporting substance. The domains containing the component [α] are independently located in the matrix. Such a matrix-domain structure can be confirmed by observing the surface of the charge transport layer or by observing the cross section of the charge transport layer.

The observation of the state of the matrix-domain structure or measurement of domains can be performed, for example, using a commercially available laser microscope, optical microscope, electron microscope, or atomic force microscope. Using the microscope, at a predetermined magnification, the state of the matrix-domain structure can be observed or the domains can be measured.

The number-average particle size of domains containing the component [α] according to aspects of the present invention may be 50 to 1,000 nm. Furthermore, the particle-size distribution of the domains may be narrow in view of continuousness of the effect of reducing contact stress. Regarding the number-average particle size according to aspects of the present invention, 100 domains are selected at random from domains observed with the microscope in a vertical cross section of the charge transport layer according to aspects of the present invention. The maximum size of each of the selected domains is measured, and the maximum sizes of the domains are averaged to calculate the number-average particle size of the domains. In addition, by observing the cross section of the charge transport layer with the microscope, image information in the depth direction is obtained, and it is also possible to obtain a 3D image of the charge transport layer.

The matrix-domain structure of the charge transport layer of the electrophotographic photosensitive member according to aspects of the present invention can be formed using a charge transport layer coating solution containing the components [α] and [β] and a charge-transporting substance. By applying the charge transport layer coating solution onto the charge generation layer, followed by drying, the electrophotographic photosensitive member according to aspects of the present invention can be produced.

In the matrix-domain structure according to aspects of the present invention, domains containing the component [α] are formed in the matrix containing the component [β] and the charge-transporting substance. Since domains containing the component [α] are formed not only on the surface of the charge transport layer but also inside the charge transport layer, it is believed that the effect of reducing contact stress is exhibited continuously. More particularly, the reason for this is believed to be that the siloxane resin component having the effect of reducing contact stress, which is decreased by sliding of members, such as paper and a cleaning blade, can be supplied from the domains in the charge transport layer.

The present inventors assume the reason for excellence in terms of both continuous reduction of contact stress and potential stability during repeated use in the electrophotographic photosensitive member according to aspects of the present invention to be as follows.

In order to suppress potential variation during repeated use of the electrophotographic photosensitive member including the charge transport layer having the matrix-domain structure according to aspects of the present invention, it is important to reduce as much as possible the content of the charge-transporting substance in the domains in the formed matrix-domain structure.

Furthermore, by incorporating specific amounts of the repeating structural unit represented by the formula (B) and the repeating structural unit represented by the formula (C) into the structure of the polycarbonate resin A, it is believed that the domains can be easily formed in the matrix. This is attributable to the fact that the polycarbonate resin A has the repeating structural unit represented by the formula (B) in the resin. That is, the ether or thioether structure, which is the central skeleton of the formula (B), is likely to bend, and the polycarbonate resin A may be relatively freely arranged in space. For these reasons, the polycarbonate resin A easily forms domains. The content of the repeating structural unit represented by the formula (B) in the polycarbonate resin A is 10% to 30% by mass relative to the total mass of the polycarbonate resin A. The content of the repeating structural unit represented by the formula (C) is 25% to 85% by mass relative to the total mass of the polycarbonate resin A. When the content of the repeating structural unit represented by the formula (B) is less than 10% by mass, the polycarbonate resin A tends to spread spatially, separation of the charge transport layer coating solution is promoted, and extreme separation from the polycarbonate resin D is liable to be promoted. Consequently, the domains of the matrix-domain structure according to aspects of the present invention cannot be formed, and therefore, the light transmittance of the charge transport layer is decreased, and the charge-transporting substance is aggregated or precipitated on the surface of the charge transport layer, resulting in a decrease in potential stability during repeated use. When the content of the repeating structural unit represented by the formula (B) exceeds 30% by mass, formation of domains becomes unstable, and the domain size tends to be non-uniform. As a result, the potential stability during repeated use is degraded. The reason for this is believed to be that the amount of the charge-transporting substance incorporated into the domains increases.

[Component [α]]

The component [α] is a polycarbonate resin A which has a repeating structural unit represented by the formula (A) below, a repeating structural unit represented by the formula (B) below, and a repeating structural unit represented by the formula (C) below and in which the content of a siloxane moiety is 5% to 40% by mass, the content of the repeating structural unit represented by the formula (B) below is 10% to 30% by mass, and the content of the repeating structural unit represented by the formula (C) below is 25% to 85% by mass.

(A)

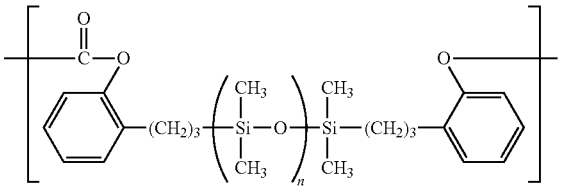

In the formula (A), n represents the number of repetitions of a structure within the brackets, and the average value of n for the polycarbonate resin A is 20 to 60.

(B)

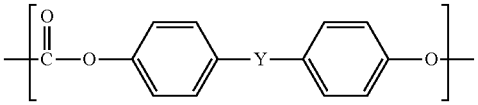

In the formula (B), Y represents an oxygen atom or sulfur atom.

(C)

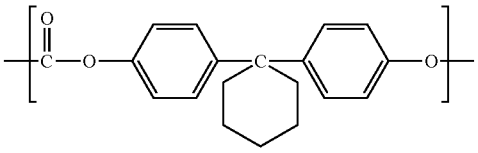

In the formula (A), n represents the number of repetitions of a structure within the brackets, and the average value of n for the polycarbonate resin A is 20 to 60. Furthermore, according to aspects of the invention, the average value of n may be 30 to 50 in view of both continuous reduction of stress and suppression of potential variation during repeated use. Furthermore, the number n of repetitions of a structure within the brackets may be within the range of ±10% of the average value of the number n of repetitions from the standpoint that the advantageous effects according to aspects of the present invention can be stably obtained.

Table 1 shows examples of the repeating structural unit represented by the formula (A).

TABLE 1

| Repeating structural unit represented by formula (A) | Average value of n |
|---|---|
| Example of repeating structural unit (A-1) | 20 |
| Example of repeating structural unit (A-2) | 30 |
| Example of repeating structural unit (A-3) | 40 |
| Example of repeating structural unit (A-4) | 50 |
| Example of repeating structural unit (A-5) | 60 |

Among these, the example of repeating structural unit (A-3) may be provided.

Furthermore, the polycarbonate resin A may have a siloxane structure represented by the formula (E) below as a terminal structure.

(E)

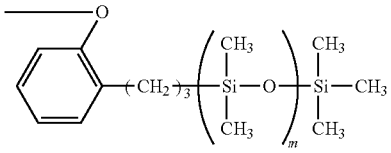

In the formula (E), m represents the number of repetitions of a structure within the brackets, and the average value of m for the polycarbonate resin A is 20 to 60. Furthermore, according to one aspect, the average value of m is 30 to 50 and the average value of the number n of repetitions of a structure within the brackets in the formula (A) is equal to the average value of the number m of repetitions of a structure within the brackets in the formula (E) in view of both continuous reduction of stress and potential stability during repeated use. Furthermore, the number m of repetitions of a structure within the brackets may be within the range of ±10% of the average value of the number m of repetitions from the standpoint that the advantageous effects according to aspects of the present invention can be stably obtained.

Table 2 shows examples of the polycarbonate resin A having the repeating structural unit represented by the formula (A) as the siloxane structure and the repeating structural unit represented by the formula (E) as the terminal structure.

TABLE 2

| Repeating structural unit represented by formula (A) and formula (E) | Average value of n | Average value of m |
|---|---|---|
| Example of repeating structural unit (A-6) | 20 | 20 |
| Example of repeating structural unit (A-7) | 30 | 30 |
| Example of repeating structural unit (A-8) | 40 | 40 |
| Example of repeating structural unit (A-9) | 50 | 50 |
| Example of repeating structural unit (A-10) | 60 | 60 |
| Example of repeating structural unit (A-11) | 20 | 40 |
| Example of repeating structural unit (A-12) | 40 | 20 |

Specific examples of the repeating structural unit represented by the formula (B) will be shown below.

(B-1)

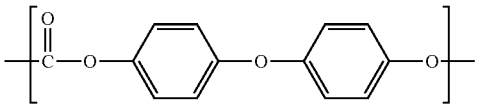

(B-2)

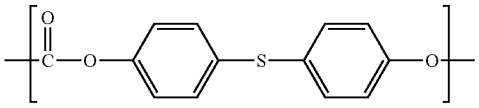

Among these, the repeating structural unit represented by the formula (B-1) may be provided.

Furthermore, the polycarbonate resin A contains the repeating structural unit represented by the formula (B) in the amount of 10% to 30% by mass relative to the total mass of the polycarbonate resin A. When the content of the repeating structural unit represented by the formula (B) is 10% by mass or more, domains are efficiently formed in the matrix containing the component [β] and the charge-transporting substance. Furthermore, when the content of the repeating structural unit represented by the formula (B) is 30% by mass or less, formation of aggregates of the charge-transporting substance in the domains containing the component [α] is suppressed, and it is possible to sufficiently obtain potential stability during repeated use.

The repeating structural unit represented by the formula (C) will be described below. The polycarbonate resin A contains the repeating structural unit represented by the formula (C) in the amount of 25% to 85% by mass relative to the total mass of the polycarbonate resin A. When the content of the repeating structural unit represented by the formula (C) is 25% by mass or more, domains are efficiently formed in the matrix containing the component [β] and the charge-transporting substance. Furthermore, when the content of the repeating structural unit represented by the formula (C) is 85% by mass or less, formation of aggregates of the charge-transporting substance in the domains containing the component [α] is suppressed, and it is possible to sufficiently obtain potential stability during repeated use.

Furthermore, the polycarbonate resin A contains a siloxane moiety in the amount of 5% to 40% by mass relative to the total mass of the polycarbonate resin A. When the content of the siloxane moiety is less than 5% by mass, the continuous effect of reducing contact stress cannot be obtained sufficiently, and it is not possible to efficiently form domains in the matrix containing the component [β] and the charge-transporting substance. Furthermore, when the content of the siloxane moiety is more than 40% by mass, the charge-transporting substance forms aggregates in the domains containing the component [α], and it is not possible to sufficiently obtain potential stability during repeated use.

In aspects of the present invention, the siloxane moiety refers to a moiety containing silicon atoms at both ends constituting a siloxane portion, groups binding thereto, oxygen atoms and silicon atoms located between the silicon atoms at both ends, and groups binding thereto. Specifically, in aspects of the present invention, for example, in the case of the repeating structural unit represented by the formula (A-S) below, the siloxane moiety is a segment surrounded by the broken line shown below. Furthermore, the polycarbonate resin A may have a siloxane structure as a terminal structure. In such a case, for example, in the case of the repeating structural unit represented by the formula (E-S) below, the siloxane moiety is a segment surrounded by the broken line shown below. In this case, the content of the siloxane moiety in the polycarbonate resin A corresponds to the total of the segments shown in the formula (A-S) and the formula (E-S), which is 5% to 40% by mass relative to the total mass of the polycarbonate resin A.

(A-S)

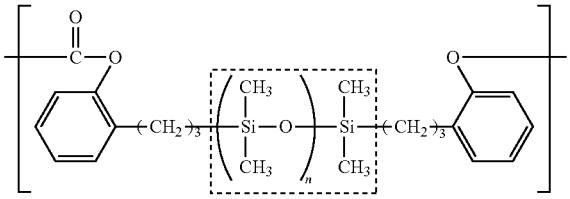

(E-S)

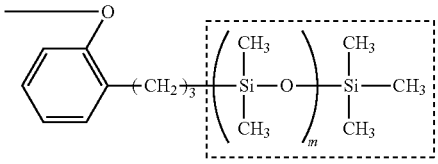

That is, the structures shown below are the siloxane moieties in the formula (A-S) and the formula (E-S).

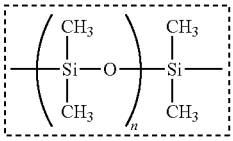

Siloxane moiety in formula (A-S)

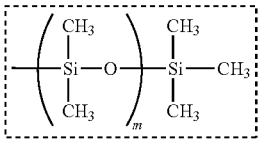

Siloxane moiety in formula (E-S)

The content of the siloxane moiety relative to the total mass of the polycarbonate resin A according to aspects of the present invention can be analyzed by a general analysis method. Examples of the analysis method will be described below.

First, the charge transport layer serving as the surface layer of the electrophotographic photosensitive member is dissolved in a solvent. Then, various materials contained in the charge transport layer serving as the surface layer are separated by a separation apparatus capable of separating and recovering the individual components, such as size exclusion chromatography or high-performance liquid chromatography. The separated polycarbonate resin A is hydrolyzed in the presence of an alkali or the like into a carboxylic acid portion, a bisphenol portion, and a phenol portion. The resulting bisphenol and phenol portions are subjected to nuclear magnetic resonance spectrum analysis and mass spectrometry to calculate the number of repetitions of the siloxane portion and the molar ratio thereof, which are then converted into the content (mass ratio).

The polycarbonate resin A used in aspects of the present invention is a copolymer of a repeating structural unit represented by the formula (A), a repeating structural unit represented by the formula (B), and a repeating structural unit represented by the formula (C). The copolymerization form may be any one of block copolymerization, random copolymerization, and alternating copolymerization.

The weight-average molecular weight of the polycarbonate resin A used in aspects of the present invention may be 30,000 to 150,000 in view of formation of domains in the matrix containing the component [β] and the charge-transporting substance, such as 40,000 to 100,000.

According to aspects of the present invention, the weight-average molecular weight of a resin is a weight-average molecular weight in terms of polystyrene measured, in accordance with an ordinary method, by the method described in Japanese Patent Laid-Open No. 2007-79555.

In aspects of the present invention, the copolymerization ratio of the polycarbonate resin A can be confirmed by the conversion method based on the peak position and the peak area ratio of hydrogen atoms (hydrogen atoms constituting the resin) obtained by $^{1}$H-NMR measurement of the resin, which is a commonly used method.

The polycarbonate resin A used in aspects of the present invention can be synthesized by an ester exchange method or phosgene method.

In aspects of the present invention, the content of the siloxane moiety in the polycarbonate resin A may be 1% to 20% by mass relative to the total mass of all the resins in the charge transport layer. When the content of the siloxane moiety is 1% to 20% by mass, the matrix-domain structure is stably formed, and it is possible to highly achieve both continuous reduction of contact stress and potential stability during repeated use. Furthermore, the content of the siloxane moiety may be 2% to 10% by mass, which can enhance continuous reduction of contact stress and potential stability during repeated use.

[Component [β]]

The component [β] is a polycarbonate resin D which has a repeating structural unit represented by the formula (D) below.

(D)

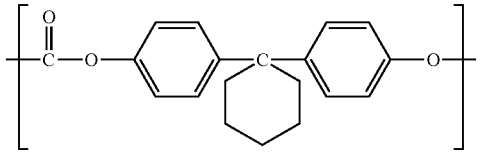

The polycarbonate resin D which is contained in the component [β] according to aspects of the present invention and which has a repeating structural unit represented by the formula (D) will be described. The polycarbonate resin D having a repeating structural unit represented by the formula (D) in aspects of the present invention, when combined with the polycarbonate resin A, is not easily incorporated into the domains, and forms a uniform matrix together with the charge-transporting substance. Accordingly, it is possible to obtain the effects of continuous reduction of contact stress and potential stability during repeated use. According to one aspect, the component [β] does not have a siloxane moiety in view of formation of a uniform matrix together with the charge-transporting substance. Furthermore, according to one aspect, the component [β] does not have a repeating structural unit including an ether structure or thioether structure. Furthermore, the component [β] may contain, in addition to the repeating structural unit represented by the formula (D), another repeating structural unit as a copolymer structure with the formula (D). The content of the repeating structural unit represented by the formula (D) in the component [β] may be 50% by mass or more relative to the component [β] in view of formation of a uniform matrix together with the charge-transporting substance. According to one aspect, the content of the repeating structural unit represented by the formula (D)

is 70% by mass or more. Specific examples of the other repeating structural unit will be shown below.

(2-1)

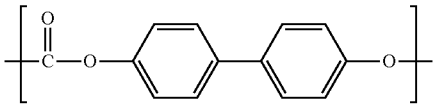

(2-2)

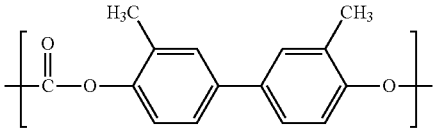

(2-3)

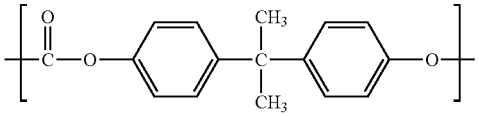

(2-4)

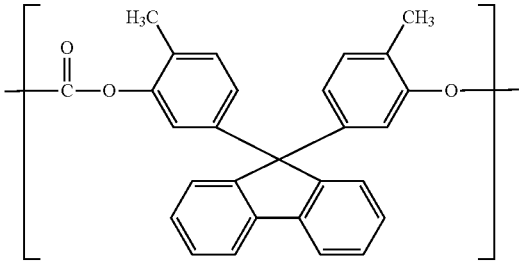

Among these, the repeating structural unit represented by the formula (2-1) or (2-3) may be provided according to one aspect.

[Charge-transporting Substance]

Examples of the charge-transporting substance include triarylamine compounds, hydrazone compounds, styryl compounds, and stilbenzene compounds. These charge-transporting substances may be used alone or in combination of two or more. In aspects of the present invention, compounds having a structure represented by the formula (1a), (1a'), (1b), or (1b') below and the like are used.

(1a)

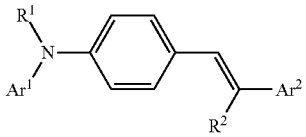

(1a')

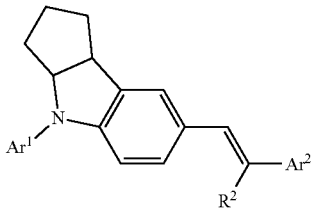

In the formulae (1a) and (1a'), $Ar^1$ represents a phenyl group, or a phenyl group having, as a substituent, a methyl group or ethyl group. $Ar^2$ represents a phenyl group; a phenyl group having, as a substituent, a methyl group; a phenyl group having, as a substituent, a monovalent group represented by —CH═CH—Ta (where Ta represents a monovalent group derived by removing one hydrogen atom from a benzene ring of triphenylamine, or a monovalent group derived by removing one hydrogen atom from a benzene ring of triphenylamine having, as a substituent, a methyl group or ethyl group), or a biphenylyl group. $R^1$ represents a phenyl group; a phenyl group having, as a substituent, a methyl group; or a phenyl group having, as a substituent, a monovalent group represented by —CH═C($Ar^3$)$Ar^4$ (where $Ar^3$ and $Ar^4$ each independently represent a phenyl group, or a phenyl group having, as a substituent, a methyl group). $R^2$ represents a hydrogen atom, a phenyl group, or a phenyl group having, as a substituent, a methyl group.

(1b)

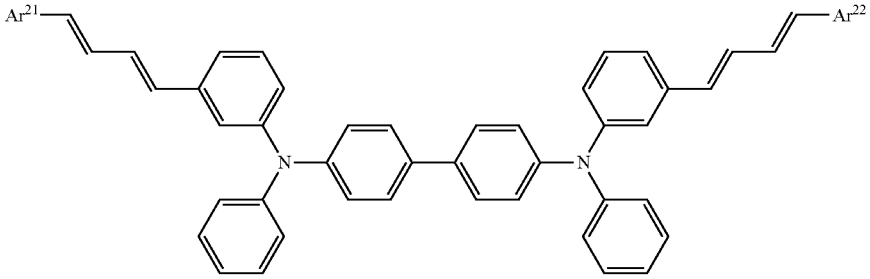

(1b')

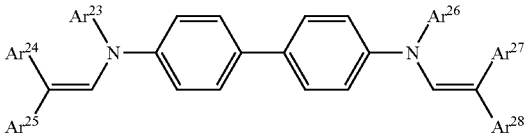

In the formula (1b), $Ar^{21}$ and $Ar^{22}$ each independently represent a phenyl group or a tolyl group. In the formula (1b'), $Ar^{23}$ and $Ar^{26}$ each independently represent a phenyl group, or a phenyl group having, as a substituent, a methyl group. $Ar^{24}$, $Ar^{25}$, $Ar^{27}$, and $Ar^{28}$ each independently represent a phenyl group or a tolyl group.

Specific examples of the charge-transporting substance used in aspects of the present invention will be shown below. Note that the formulae (1-1) to (1-10) below are specific examples of compounds having the structure represented by the formula (1a) or (1a'), and the formulae (1-15) to (1-18) below are specific examples of compounds having the structure represented by the formula (1b) or (1b').

(1-1)

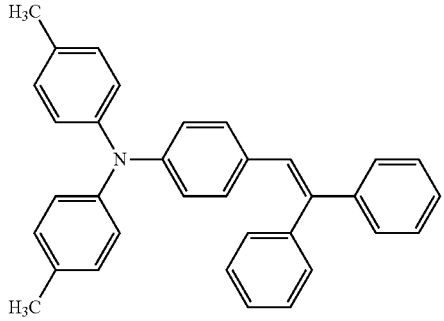

(1-2)

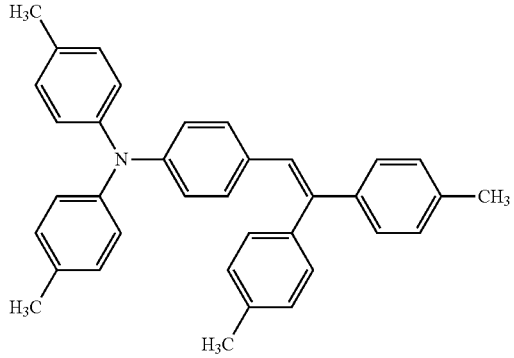

(1-3)

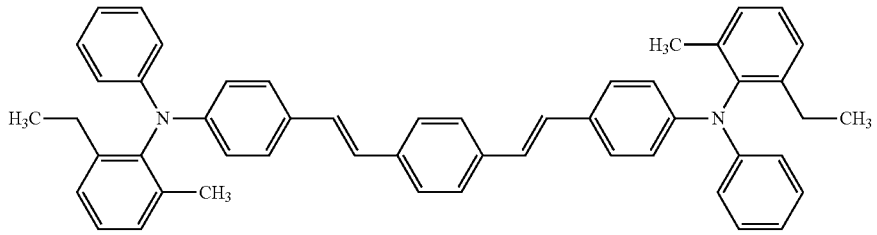

(1-4)

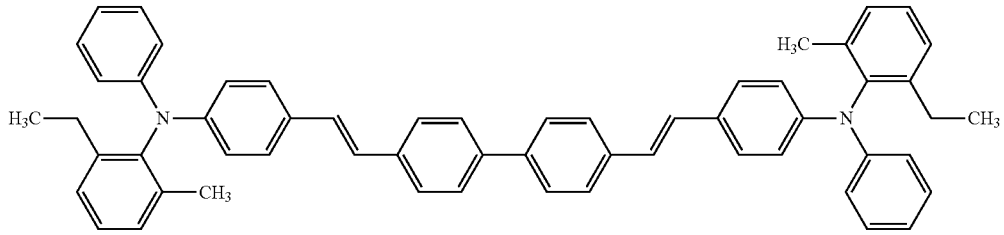

(1-5)

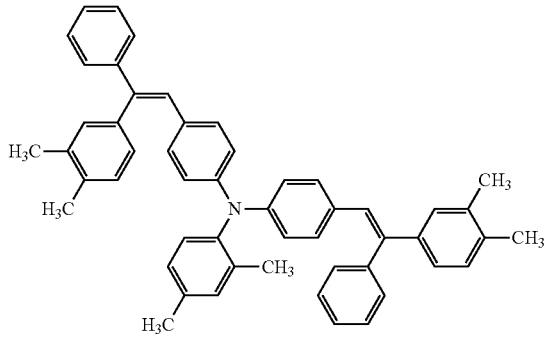

(1-6)

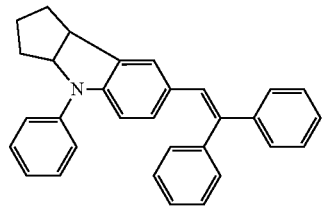

-continued
(1-7)
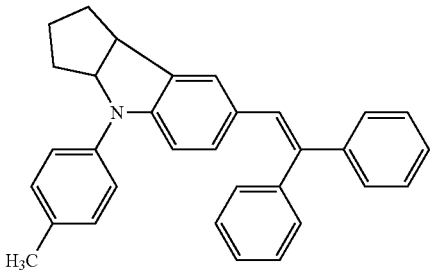
(1-8)
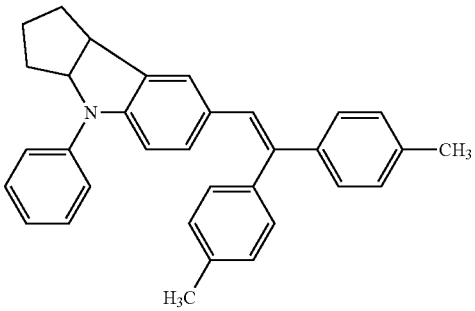
(1-9)
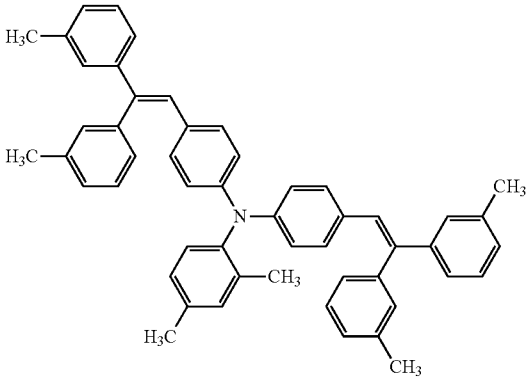
(1-10)
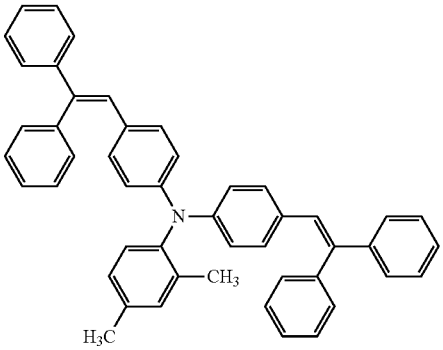
(1-11)
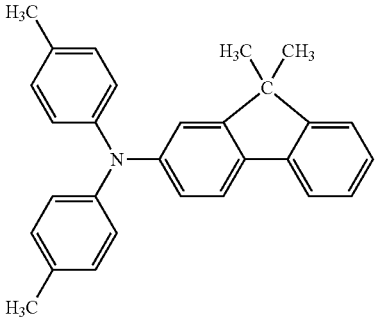
(1-12)
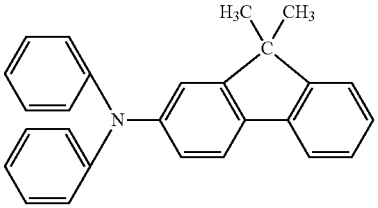
(1-13)
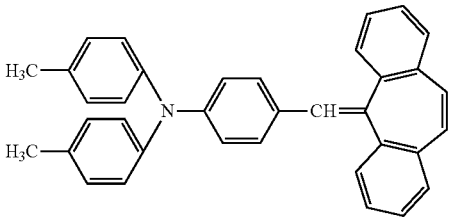
(1-14)
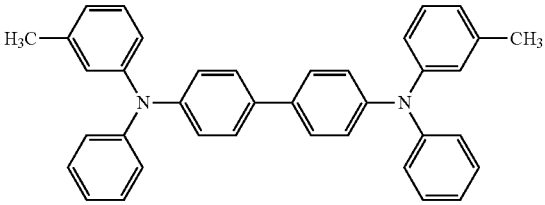
(1-15)
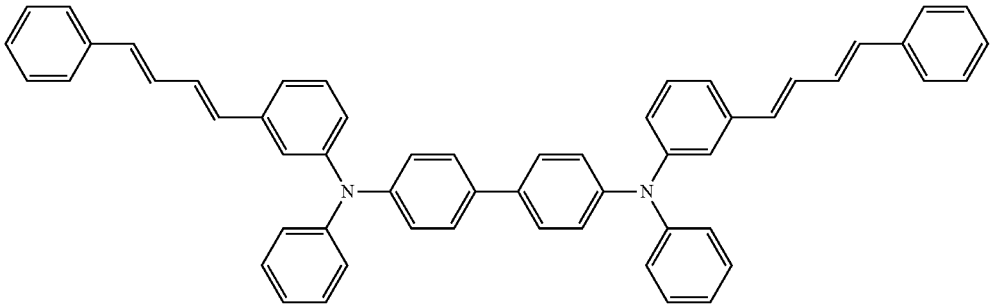

-continued (1-16)

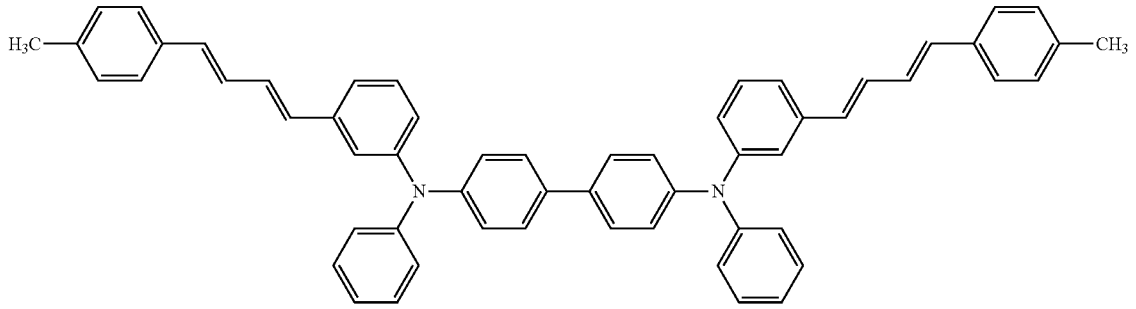

(1-17)

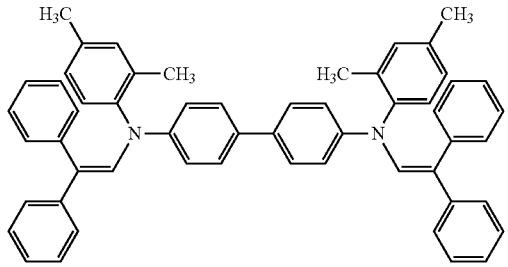

(1-18)

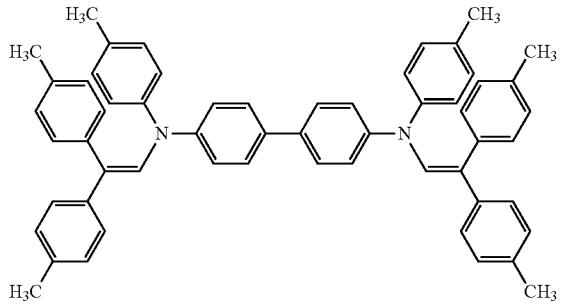

Among these, the charge-transporting substance may be a charge-transporting substance having the structure represented by the formula (1-1), (1-3), (1-5), (1-7), (1-11), (1-13), (1-14), (1-15), or (1-17), according to one aspect.

The charge transport layer, which is the surface layer of the electrophotographic photosensitive member according to aspects of the present invention, contains the polycarbonate resin A and the polycarbonate resin D as resins, and another resin may be further mixed therewith. Examples of the other resin which may be mixed for use include an acrylic resin, a polyester resin, and a polycarbonate resin. Among these, in view of improvement in electrophotographic characteristics, a polyester resin may be provided. When the other resin is mixed for use, the ratio between the polycarbonate resin D and the other resin may be in the range of 9:1 to 99:1 (mass ratio). In aspects of the present invention, when the other resin is mixed for use in addition to the polycarbonate resin D, the other resin to be used may not have the siloxane structure in view of formation of a uniform matrix together with the charge-transporting substance.

As a specific example of the polyester resin which may be mixed, a resin having a repeating structural unit represented by the formula (3) below may be provided.

(3)

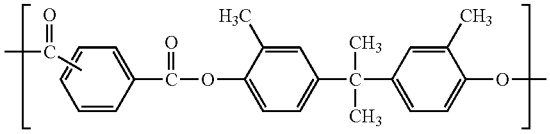

Synthesis examples of the polycarbonate resin A, which is the component [α] used in aspects of the present invention, will be shown below. The polycarbonate resin A can be synthesized using the synthesis method described in Japanese Patent Laid-Open No. 2007-199688. In aspects of the present invention, using the similar synthesis method, using starting materials corresponding to the repeating structural unit represented by the formula (A), the structural unit represented by the formula (B), and the structural unit represented by the formula (C), polycarbonate resins A shown in synthesis example of Table 3 were synthesized. The weight-average molecular weight of each of the synthesized polycarbonate resins A and the content of the siloxane moiety in the polycarbonate resin A are shown in Table 3.

Note that, in Table 3, the polycarbonate resins A(1) to A(31) correspond to a polycarbonate resin A having, as the siloxane moiety, the repeating structural unit represented by the formula (A) only. The polycarbonate resins A(32) to A(40) correspond to a polycarbonate resin A having, as the siloxane moiety, both the repeating structural unit represented by the formula (A) and the repeating structural unit represented by the formula (E). In Table 3, the content of the siloxane moiety corresponds to, as described above, the total amount of the siloxane moiety contained in the repeating structural unit represented by the formula (A) and the repeating structural unit represented by the formula (E) for the polycarbonate resin A. In the synthesis of the polycarbonate resins A(32) to A(40), synthesis was performed so that the ratio between the starting materials for the repeating structural unit represented by the formula (A) and the repeating structural unit represented by the formula (E) was 1:1 in terms of mass ratio.

TABLE 3

| Component [α] (Polycarbonate resin A) | Repeating structural unit represented by formula (A) | Repeating structural unit represented by formula (B) | Repeating structural unit represented by formula (C) | Content of siloxane moiety in polycarbonate resin A (mass %) | Content of formula (B) in polycarbonate resin (mass %) | Content of formula (C) in polycarbonate resin (mass %) | Weight-average molecular weight (Mw) |
|---|---|---|---|---|---|---|---|
| Polycarbonate resin A(1) | (A-3) | (B-1) | (C) | 40 | 16 | 40 | 80000 |
| Polycarbonate resin A(2) | (A-3) | (B-1) | (C) | 30 | 16 | 51 | 60000 |
| Polycarbonate resin A(3) | (A-3) | (B-1) | (C) | 18 | 16 | 64 | 75000 |
| Polycarbonate resin A(4) | (A-3) | (B-1) | (C) | 10 | 16 | 73 | 50000 |
| Polycarbonate resin A(5) | (A-3) | (B-1) | (C) | 5 | 16 | 79 | 70000 |
| Polycarbonate resin A(6) | (A-3) | (B-1) | (C) | 5 | 10 | 85 | 73000 |
| Polycarbonate resin A(7) | (A-3) | (B-1) | (C) | 40 | 30 | 26 | 65000 |
| Polycarbonate resin A(8) | (A-3) | (B-1) | (C) | 5 | 30 | 65 | 80000 |
| Polycarbonate resin A(9) | (A-3) | (B-1) | (C) | 40 | 10 | 46 | 85000 |
| Polycarbonate resin A(10) | (A-1) | (B-1) | (C) | 40 | 10 | 42 | 70000 |
| Polycarbonate resin A(11) | (A-1) | (B-1) | (C) | 30 | 30 | 34 | 66000 |
| Polycarbonate resin A(12) | (A-1) | (B-1) | (C) | 5 | 10 | 84 | 90000 |
| Polycarbonate resin A(13) | (A-1) | (B-1) | (C) | 40 | 27 | 25 | 77000 |
| Polycarbonate resin A(14) | (A-2) | (B-1) | (C) | 40 | 29 | 26 | 70000 |
| Polycarbonate resin A(15) | (A-2) | (B-1) | (C) | 20 | 20 | 57 | 68000 |
| Polycarbonate resin A(16) | (A-2) | (B-1) | (C) | 5 | 10 | 84 | 85000 |
| Polycarbonate resin A(17) | (A-2) | (B-1) | (C) | 40 | 10 | 45 | 65000 |
| Polycarbonate resin A(18) | (A-4) | (B-1) | (C) | 40 | 30 | 27 | 75000 |
| Polycarbonate resin A(19) | (A-4) | (B-1) | (C) | 20 | 20 | 58 | 90000 |
| Polycarbonate resin A(20) | (A-4) | (B-1) | (C) | 5 | 10 | 85 | 54000 |
| Polycarbonate resin A(21) | (A-4) | (B-1) | (C) | 40 | 10 | 47 | 60000 |
| Polycarbonate resin A(22) | (A-5) | (B-1) | (C) | 40 | 30 | 27 | 70000 |
| Polycarbonate resin A(23) | (A-5) | (B-1) | (C) | 20 | 20 | 59 | 72000 |
| Polycarbonate resin A(24) | (A-5) | (B-1) | (C) | 5 | 10 | 85 | 70000 |
| Polycarbonate resin A(25) | (A-5) | (B-2) | (C) | 40 | 10 | 47 | 55000 |
| Polycarbonate resin A(26) | (A-3) | (B-2) | (C) | 40 | 30 | 26 | 80000 |
| Polycarbonate resin A(27) | (A-3) | (B-2) | (C) | 20 | 20 | 58 | 60000 |
| Polycarbonate resin A(28) | (A-3) | (B-2) | (C) | 5 | 10 | 85 | 65000 |
| Polycarbonate resin A(29) | (A-3) | (B-2) | (C) | 40 | 10 | 46 | 75000 |
| Polycarbonate resin A(30) | (A-2) | (B-2) | (C) | 20 | 20 | 57 | 73000 |
| Polycarbonate resin A(31) | (A-4) | (B-2) | (C) | 20 | 20 | 58 | 85000 |
| Polycarbonate resin A(32) | (A-8) | (B-1) | (C) | 40 | 30 | 27 | 80000 |
| Polycarbonate resin A(33) | (A-8) | (B-1) | (C) | 19 | 16 | 65 | 75000 |
| Polycarbonate resin A(34) | (A-8) | (B-1) | (C) | 5 | 10 | 85 | 77000 |
| Polycarbonate resin A(35) | (A-8) | (B-1) | (C) | 40 | 10 | 47 | 64000 |
| Polycarbonate resin A(36) | (A-7) | (B-1) | (C) | 20 | 20 | 58 | 71000 |
| Polycarbonate resin A(37) | (A-7) | (B-2) | (C) | 20 | 20 | 58 | 73000 |
| Polycarbonate resin A(38) | (A-9) | (B-1) | (C) | 20 | 20 | 59 | 64000 |
| Polycarbonate resin A(39) | (A-11) | (B-1) | (C) | 20 | 20 | 58 | 92000 |
| Polycarbonate resin A(40) | (A-12) | (B-1) | (C) | 20 | 20 | 58 | 83000 |

In the polycarbonate resin A(3), the maximum value of the number n of repetitions of the structure within the brackets of the structure represented by the formula (A-3) was 43, and the minimum value thereof was 37. In the polycarbonate resin A(33), the maximum value of the number n of repetitions of the structure within the brackets of the structure represented by the formula (A) was 43, the minimum value thereof was 37, the maximum value of the number m of repetitions of the structure within the brackets of the structure represented by the formula (E) was 42, and the minimum value thereof was 38.

The structure of an electrophotographic photosensitive member according to aspects of the present invention will be described below. The electrophotographic photosensitive member according to aspects of the present invention includes a support, a charge generation layer provided on the support, and a charge transport layer provided on the charge generation layer. Furthermore, in the electrophotographic photosensitive member, the charge transport layer serves as a surface layer (uppermost layer) of the electrophotographic photosensitive member.

Furthermore, the charge transport layer of the electrophotographic photosensitive member according to aspects of the present invention contains the components [α] and [β] and the charge-transporting substance. Furthermore, the charge transport layer may have a laminated structure. In this case, at least one charge transport layer located nearest the surface is made to have the matrix-domain structure.

As the electrophotographic photosensitive member, generally, a cylindrical electrophotographic photosensitive member including a photosensitive layer disposed on a cylindrical support is widely used. The electrophotographic photosensitive member may be belt-shaped, sheet-shaped, or the like.

[Support]

As the support used in the electrophotographic photosensitive member according to aspects of the present invention, a support having conductivity (conductive support) may be provided, and, for example, aluminum, an aluminum alloy, stainless steel, or the like may be used. In the case of a support made of aluminum or an aluminum alloy, an ED tube, an EI tube, or a support obtained by subjecting these to cutting, electrolytic grinding, or wet or dry honing may also be used. Furthermore, a metal support or a resin support having a thin film formed of a conductive material, such as aluminum, an aluminum alloy, or an indium oxide-tin oxide alloy, on the surface thereof can also be used. The surface of the support may be subjected to cutting treatment, roughening treatment, alumite treatment, or the like.

Furthermore, a support formed by impregnating a resin or the like with conductive particles, such as carbon black, tin oxide particles, titanium oxide particles, or silver particles, and a plastic having a conductive resin can also be used. In the electrophotographic photosensitive member according to aspects of the present invention, a conductive layer including conductive particles and a resin may be provided on the support. The conductive layer is a layer formed using a conductive layer coating solution prepared by dispersing conductive particles in a resin. Examples of the conductive particles include carbon black, acetylene black, metal powders, such as aluminum, nickel, iron, nichrome, copper, zinc, and silver, and metal oxide powders, such as conductive tin oxide and ITO.

Examples of the resin used in the conductive layer include polyester, polycarbonate, polyvinyl butyral, acrylic resins, silicone resins, epoxy resins, melamine resins, urethane resins, phenol resins, and alkyd resins.

As a solvent of the conductive layer coating solution, for example, an ether solvent, an alcohol solvent, a ketone solvent, or a aromatic hydrocarbon solvent may be used. The thickness of the conductive layer may be 0.2 to 40 μm, such as 1 to 35 μm, and even 5 to 30 μm.

In the electrophotographic photosensitive member according to aspects of the present invention, an intermediate layer may be provided between the support or the conductive layer and the charge generation layer.

The intermediate layer can be formed by applying an intermediate layer coating solution containing a resin onto the support or the conductive layer, followed by drying or curing.

Examples of the resin used in the intermediate layer include polyacrylic acids, methyl cellulose, ethyl cellulose, polyamides, polyimides, polyamide-imides, polyamic acid, melamine resins, epoxy resins, and polyurethane. The resin used in the intermediate layer is may be a thermoplastic resin, and specifically, a thermoplastic polyamide may be provided. As the polyamide, a low crystalline or amorphous copolymer nylon that can be applied in the form of a solution may be provided according to one aspect.

The thickness of the intermediate layer may be 0.05 to 40 μm, such as 0.1 to 30 μm. Furthermore, the intermediate layer may contain semiconductive particles, an electron-transporting substance, or an electron-accepting substance.

[Charge Generation Layer]

In the electrophotographic photosensitive member according to aspects of the present invention, a charge generation layer is provided on the support, the conductive layer, or the intermediate layer.

Examples of the charge-generating substance used in the electrophotographic photosensitive member according to aspects of the present invention include azo pigments, phthalocyanine pigments, indigo pigments, and perylene pigments. These charge-generating substances may be used alone or in combination of two or more. Among these, in particular, oxy-titanium phthalocyanine, hydroxy gallium phthalocyanine, chloro-gallium phthalocyanine, and the like may be provided in view of high sensitivity.

Examples of the resin used in the charge generation layer include polycarbonate, polyester, butyral resins, polyvinyl acetal, acrylic resins, vinyl acetate resins, and urea resins. Among these, butyral resins may be provided according to one aspect. These resins may be used alone or in combination of two or more as a mixture or a copolymer.

The charge generation layer can be formed by application of a charge generation layer coating solution obtained by dispersing a charge-generating substance together with a resin and a solvent, followed by drying. Furthermore, the charge generation layer may be a film formed by vapor deposition of the charge-generating substance.

As the dispersion method, for example, a method using a homogenizer, ultrasonic waves, a ball mill, a sand mill, an attritor, or a roll mill may be mentioned.

Regarding the ratio between the charge-generating substance and the resin, the amount of the charge-generating substance may be 0.1 to 10 parts by mass, such as 1 to 3 parts by mass, relative to 1 part by mass of the resin.

Examples of the solvent used in the charge generation layer coating solution include alcohol solvents, sulfoxide solvents, ketone solvents, ether solvents, ester solvents, and aromatic hydrocarbon solvents.

The thickness of the charge generation layer may be 0.01 to 5 μm, such as 0.1 to 2 μm. Furthermore, optionally, it is possible to add various types of sensitizers, antioxidants, ultraviolet absorbers, plasticizers, and the like to the charge generation layer. In addition, in order to prevent the flow of charges from being disrupted in the charge generation layer, an electron-transporting substance or an electron-accepting substance may be incorporated into the charge generation layer.

[Charge Transport Layer]

In the electrophotographic photosensitive member according to aspects of the present invention, a charge transport layer is provided on the charge generation layer.

The charge transport layer, which is the surface layer of the electrophotographic photosensitive member according to aspects of the present invention, contains the components [α] and [β] and the charge-transporting substance, and as described above, another resin may be further mixed therewith. Examples of the other resin which may be mixed for use are as described above. The charge-transporting substances used in the charge transport layer according to aspects of the present invention may be used alone or in combination of two or more.

The charge transport layer can be formed by application of a charge transport layer coating solution obtained by dissolving the charge-transporting substance and the resins in a solvent, followed by drying.

Regarding the ratio between the charge-transporting substance and the resin, the amount of the charge-transporting substance may be 0.4 to 2 parts by mass, such as 0.5 to 1.2 parts by mass, relative to 1 part by mass of the resin.

Examples of the solvent used in the charge transport layer coating solution include ketone solvents, ester solvents, ether solvents, and aromatic hydrocarbon solvents. These solvents may be used alone or in combination of two or more. Among these solvents, use of ether solvents or aromatic hydrocarbon solvents is may be provided in view of resin solubility.

The thickness of the charge transport layer may be 5 to 50 μm, such as 10 to 35 μm. Furthermore, optionally, it is possible to add an antioxidant, an ultraviolet absorber, a plasticizer, and the like to the charge transport layer.

Various types of additives can be added to the individual layers of the electrophotographic photosensitive member according to aspects of the present invention. Examples of the additives include an antidegradant, such as an antioxidant, an ultraviolet absorber, or a stabilizer against light, and fine particles, such as organic fine particles and inorganic fine particles. Examples of the antidegradant include a hindered phenol antioxidant, a hindered amine stabilizer against light, a sulfur atom-containing antioxidant, and a phosphorus atom-containing antioxidant. Examples of the organic fine particles include fluorine atom-containing resin particles and polymer resin particles, such as polystyrene fine particles and polyethylene resin particles. Examples of the inorganic fine particles include metal oxides, such as silica and alumina.

When the individual layer coating solutions are applied, a dip application method (dip coating method), a spray coating method, a spinner coating method, a roller coating method, a Meyer bar coating method, a blade coating method, or the like can be used.

[Electrophotographic Apparatus]

FIGURE shows an example of a schematic structure of an electrophotographic apparatus provided with a process cartridge including an electrophotographic photosensitive member according to aspects of the present invention.

In FIGURE, reference sign 1 denotes a cylindrical electrophotographic photosensitive member, which is rotated around a shaft 2 at a predetermined peripheral speed in the direction indicated by an arrow. The surface of the electrophotographic photosensitive member 1 which is rotated is uniformly charged to a predetermined negative potential by charging means (primary charging means: charging roller or the like) 3 during rotation. Subsequently, the surface receives exposure light (image exposure light) 4 output from exposing means (not shown), such as slit exposure or laser beam scanning exposure, and intensity-modified according to a time-series electrical digital image signal of target image information. Thus, an electrostatic latent image corresponding to the target image is sequentially formed on the surface of the electrophotographic photosensitive member 1.

The electrostatic latent image formed on the surface of the electrophotographic photosensitive member 1 is developed by a toner which is contained in a developer of developing means 5, by reversal development, to be a toner image. Subsequently, the toner image formed and carried on the surface of the electrophotographic photosensitive member 1 is sequentially transferred onto a transfer medium (paper or the like) P by a transferring bias from transferring means (transfer roller or the like) 6. In this process, the transfer medium P is fed from transfer medium feeding means (not shown) into a portion (contact portion) between the electrophotographic photosensitive member 1 and the transferring means 6 in synchronization with the rotation of the electrophotographic photosensitive member 1. Furthermore, a bias voltage having a reverse polarity to the charge polarity of the toner is applied to the transferring means 6 from a bias supply (not shown).

The transfer medium P to which the toner image has been transferred is separated from the surface of the electrophotographic photosensitive member 1 and conveyed to fixing means 8 where the toner image is subjected to a fixing process. Then, the transfer medium P is printed out as an image-formed product (print or copy) to the outside of the apparatus.

The remaining developer untransferred (remaining toner untransferred) on the surface of the electrophotographic photosensitive member 1, from which the toner image has been transferred, is removed by cleaning means (cleaning blade or the like) 7 so that the surface is cleaned. Subsequently, decharging treatment is performed by pre-exposure light (not shown) from pre-exposing means (not shown), and then the electrophotographic photosensitive member 1 is repeatedly used for image formation. In addition, in the case where the charging means 3 is contact charging means using a charging roller or the like as shown in FIGURE, pre-exposure is not necessarily required.

In aspects of the present invention, a plurality of components selected from the electrophotographic photosensitive member 1, the charging means 3, the developing means 5, the transferring means 6, and the cleaning means 7 may be held in a container and integrally held together to constitute a process cartridge. Furthermore, the process cartridge may be configured so as to be detachably mountable to the main body of an electrophotographic apparatus, such as a copying machine or a laser beam printer. Referring to FIGURE, the electrophotographic photosensitive member 1, the charging means 3, the developing means 5, and the cleaning means 7 are integrally supported to constitute a cartridge, and the cartridge is used as a process cartridge 9 which is detachably mountable to the main body of an electrophotographic apparatus, using guiding means 10, such as a rail of the main body of the electrophotographic apparatus.

EXAMPLES

Aspects of the present invention will be described in more detail below on the basis of examples and comparative examples. However, it is to be understood that the present invention is not limited to the examples below. In the examples, the term "part(s)" refers to "part(s) by mass".

Example 1

An aluminum cylinder with a diameter of 30 mm and a length of 260.5 mm was used as a support. Next, using 10 parts of $SnO_2$-coated barium sulfate (conductive particles), 2 parts of titanium oxide (pigment for resistance adjustment), 6 parts of a phenol resin, 0.001 parts of a silicone oil (leveling agent), and a mixed solvent containing 4 parts of methanol and 16 parts of methoxy propanol, a conductive layer coating solution was prepared. This conductive layer coating solution was applied onto the aluminum cylinder by dip coating and cured (thermally cured) at 140° C. for 30 minutes. Thereby, a conductive layer with a thickness of 15 μm was formed.

Next, an intermediate layer coating solution was prepared by dissolving 3 parts of N-methoxymethylized nylon and 3 parts of copolymer nylon in a mixed solvent containing 65 parts of methanol and 30 parts of n-butanol. This intermediate layer coating solution was applied onto the conductive layer by dip coating and dried at 100° C. for 10 minutes. Thereby, an intermediate layer with a thickness of 0.7 μm was formed.

Next, 10 parts of hydroxygallium phthalocyanine with a crystal form having strong peaks at Bragg angles (2θ±0.2°) of 7.5°, 9.9°, 16.3°, 18.6°, 25.1°, and 28.3° in CuKα characteristic X-ray diffraction (charge-generating substance) was prepared, and 250 parts of cyclohexanone and 5 parts of polyvinyl butyral (trade name: S-LEC BX-1, manufactured by Sekisui Chemical Co., Ltd.) were mixed therewith. The mixture was dispersed in a sand mill using glass beads with a diameter of 1 mm in an atmosphere of 23±3° C. for one hour. After the dispersion, 250 parts of ethyl acetate was added to prepare a charge generation layer coating solution. This charge generation layer coating solution was applied onto the intermediate layer by dip coating and dried at 100° C. for 10 minutes. Thereby, a charge generation layer with a thickness of 0.26 μm was formed.

Next, by dissolving 9 parts of a charge-transporting substance having the structure represented by the formula (1-11) and 1 part of a charge-transporting substance having the structure represented by the formula (1-14), as charge-transporting substances, 3 parts of the polycarbonate resin A(1) synthesized in Synthesis Example 1 as the component [α], and 7 parts of the polycarbonate resin D (weight-average molecular weight 80,000) as the component [β] in a mixed solvent containing 60 parts of o-xylene and 20 parts of dimethoxymethane, a charge transport layer coating solution was prepared. This charge transport layer coating solution was applied onto the charge generation layer by dip coating and dried at 120° C. for one hour. Thereby, a charge transport layer with a thickness of 16 μm was formed. It was confirmed that domains containing the component [α] were contained in the matrix containing the component [β] and the charge-transporting substances (matrix-domain structure) in the resulting charge transport layer.

In such a manner, an electrophotographic photosensitive member in which the charge transport layer served as a surface layer was produced. Table 3 shows the components [α] and [β] and the charge-transporting substance contained in the charge transport layer, the content of the siloxane moiety in the polycarbonate resin A, and the content of the siloxane moiety in the polycarbonate resin A relative to the total mass of all the resins in the charge transport layer.

Next, description will be made on evaluation. Evaluation was performed with respect to the change in light-area potential (potential variation) after repeated use of 3,000 sheets, the relative value of initial torque, the relative value of torque after repeated use of 3,000 sheets, and observation on the surface of the electrophotographic photosensitive member when the torque was measured.

As an evaluation apparatus, a laser beam printer LBP-2510 manufactured by CANON KABUSHIKI KAISHA was modified such that the charge potential (dark-area potential) of an electrophotographic photosensitive member could be adjusted and put in use. Furthermore, the contact angle of a cleaning blade made of polyurethane rubber with respect to the surface of the electrophotographic photosensitive member was set to 22.5° and the contact pressure thereof was set to 35 g/cm. Evaluation was performed under an environment of a temperature of 23° C. and a relative humidity of 15%.

<Evaluation of Potential Variation>

The amount of exposure (amount of image exposure) of a laser light source of 780 nm of the evaluation apparatus was set such that the amount of light at the surface of the electrophotographic photosensitive member was 0.3 $\mu J/cm^2$. The surface potentials (dark-area potential and light-area potential) of the electrophotographic photosensitive member were measured at the position of a developing unit by replacing the developing unit with a jig, which was fixed such that a potential measuring probe was positioned at a distance of 130 mm from the edge of the electrophotographic photosensitive member. The dark-area potential in the non-exposed portion of the electrophotographic photosensitive member was set to −450 V, and then the light-area potential, which was light-attenuated from the dark-area potential by irradiation with laser light, was measured. Furthermore, using A4-size plain paper, an image was output continuously on 3,000 sheets. The amount of change in light-area potential before and after the output was evaluated. A test chart having a coverage rate of 4% was used. The results are shown in the column of potential variation in Table 10.

<Evaluation of Relative Value of Torque>

Under the same conditions as those for the evaluation of potential variation, the driving current value (current value A) of a rotary motor of the electrophotographic photosensitive member was measured. In this evaluation, the amount of contact stress between the electrophotographic photosensitive member and the cleaning blade was evaluated. The magnitude of the current value obtained indicates the magnitude of the amount of contact stress between the electrophotographic photosensitive member and the cleaning blade.

Furthermore, an electrophotographic photosensitive member, which was to be used as the control to obtain a relative value of torque, was produced by the following method. An electrophotographic photosensitive member was produced as in Example 1 except that the polycarbonate resin A(1) as the component [α] used in the charge transport layer of the electrophotographic photosensitive member of Example 1 was changed to the component [β] in Table 4 and the component [β] only was used as the resin. This was used as a control electrophotographic photosensitive member.

Using the control electrophotographic photosensitive member thus produced, the driving current value (current value B) of a rotary motor of the electrophotographic photosensitive member was measured as in Example 1.

The ratio of the driving current value (current value A) of the rotary motor of the electrophotographic photosensitive member containing the component [α] according to aspects of the present invention thus obtained to the driving current value (current value B) of the rotary motor of the control electrophotographic photosensitive member in which the component [α] was not used was calculated. The resulting numerical value of (current value A)/(current value B) was considered as the relative value of torque and comparison was made. The numerical value of the relative value of torque indicates the degree of reduction in the amount of contact stress between the electrophotographic photosensitive member and the cleaning blade due to the use of the component [α], and a smaller numerical value of the relative value of torque indicates a larger degree of reduction in the amount of contact stress between the electrophotographic photosensitive member and the cleaning blade. The results are shown in the column of relative value of initial torque in Table 10.

Subsequently, using A4-size plain paper, an image was output continuously on 3,000 sheets. A test chart having a coverage rate of 4% was used. Then, the relative value of torque after repeated use of 3,000 sheets was determined. The relative value of torque after repeated use of 3,000 sheets was evaluated in the same manner as that in the relative value of initial torque. In this case, the control electrophotographic photosensitive member was also used repeatedly for 3,000 sheets. Using the driving current value of the rotary motor at that time, the relative value of torque after repeated use of 3,000 sheets was calculated. The results are shown in the column of relative value of torque after 3,000 sheets in Table 10.

<Evaluation of Matrix-domain Structure>

In the electrophotographic photosensitive member produced by the method described above, a cross section obtained by cutting the charge transport layer in the vertical direction was observed using an ultra-deep profile measuring microscope VK-9500 (manufactured by Keyence Corporation). In the observation, the magnification of an objective lens was set at 50 times, and a 100 μm-square region (10,000 $\mu m^2$) in the surface of the electrophotographic photosensitive member was used as a field of vision for observation. The maximum diameters of 100 domains randomly selected from those present in the field of vision were measured. The average value was calculated from the maximum diameters thus obtained and used as the number-average particle size. The result is shown in Table 10.

Examples 2 to 100

Electrophotographic photosensitive members were produced as in Example 1 except that the components [α] and [β] and the charge-transporting substance were changed to those shown in Table 5 or 6, and evaluation was performed. It was confirmed that, in the resulting charge transport layer, domains containing the component [α] were included in the matrix containing the component [β] and the charge-transporting substance. The results are shown in Table 10.

Examples 101 to 150

Electrophotographic photosensitive members were produced as in Example 1 except that the components [α] and [β] and the charge-transporting substance were changed to those shown in Table 7, and evaluation was performed. It was confirmed that, in the resulting charge transport layer, domains containing the component [α] were included in the matrix containing the component [β] and the charge-transporting substance. The results are shown in Table 11.

In addition, the weight-average molecular weight of the polycarbonate resin D used as the component [β] was as follows:

(D)/(2-3)=5/5: 60,000
(D)/(2-1)=8/2: 65,000
(D)/(2-2)=8/2: 75,000

Examples 151 to 187

Electrophotographic photosensitive members were produced as in Example 1 except that the components [α] and [β]

and the charge-transporting substance were changed to those shown in Table 8, and evaluation was performed. It was confirmed that, in the resulting charge transport layer, domains containing the component [α] were included in the matrix containing the component [β] and the charge-transporting substance. The results are shown in Table 12.

In addition, the weight-average molecular weight of the polycarbonate resin D used as the component [β] was as follows:

(D)/(2-2)=8/2: 75,000

(D)/(2-1)/(2-4)=6/2/2: 60,000

Furthermore, the weight-average molecular weight of the polyester resin represented by the formula (3) mixed as the component [β] in addition to the resin (D) was as follows: (3): 120000. Furthermore, in the repeating structural unit represented by the formula (3), the terephthalic acid/isophthalic acid ratio is 1/1.

COMPARATIVE EXAMPLES

As a comparative resin, instead of the polycarbonate resin A, a resin F (polycarbonate resin F) shown in Table 4 was synthesized.

TABLE 4

| Polycarbonate resin F | Repeating structural unit represented by formula (A) | Repeating structural unit represented by formula (B) | Repeating structural unit represented by formula (C) | Content of siloxane moiety in polycarbonate resin F (mass %) | Content of formula (B) in polycarbonate resin (mass %) | Content of formula (C) in polycarbonate resin (mass %) | Weight-average molecular weight (Mw) |
|---|---|---|---|---|---|---|---|
| Resin F(1) | (A-4) | (B-1) | (C) | 2 | 10 | 88 | 56000 |
| Resin F(2) | (A-2) | (B-1) | (C) | 50 | 20 | 23 | 68000 |
| Resin F(3) | (A-1) | (B-1) | (C) | 20 | 5 | 71 | 67000 |
| Resin F(4) | (A-1) | (B-1) | (C) | 20 | 50 | 26 | 71000 |
| Resin F(5) | (A-1) | (B-2) | (C) | 20 | 5 | 71 | 59000 |
| Resin F(6) | (A-3) | — | (C) | 20 | — | 78 | 73000 |
| Resin F(7) | (A-7) | — | (C) | 20 | — | 79 | 76000 |

Comparative Example 1

An electrophotographic photosensitive member was produced as in Example 1 except that the polycarbonate resin A(1) was changed to the resin F(1) shown in Table 4 above and changes shown in Table 9 were made. The composition of the resin contained in the charge transport layer and the content of the siloxane moiety are shown in Table 9. Evaluation was performed as in Table 1. The results are shown in Table 12. A matrix-domain structure was not confirmed in the resulting charge transport layer.

Comparative Examples 2 to 6, 15 to 20, and 27 to 36

Electrophotographic photosensitive members were produced as in Example 1 except that the polycarbonate resin A(1) was changed to the resin F shown in Table 4 above and changes shown in Table 9 were made. The composition of the resin contained in the charge transport layer and the content of the siloxane moiety are shown in Table 9. Evaluation was performed as in Example 1. The results are shown in Table 12. A matrix-domain structure was not confirmed in the resulting charge transport layer.

Comparative Examples 7 and 14

Electrophotographic photosensitive members were produced as in Example 1 except that the resin F shown in Table 4 only was used as the resin contained in the charge transport layer. The composition of the resin contained in the charge transport layer and the content of the siloxane moiety are shown in Table 9. Evaluation was performed as in Example 1. The results are shown in Table 12. A matrix-domain structure was not confirmed in the resulting charge transport layer. Furthermore, as an electrophotographic photosensitive member, which was to be used as the control to obtain a relative value of torque, the control electrophotographic photosensitive member used in Example 1 was used.

Comparative Examples 8 to 13 and 21 to 26

Electrophotographic photosensitive members were produced as in Example 1 except that the polycarbonate resin A(1) was changed to the resin F shown in Table 4 and the changes shown in Table 9 were made. The composition of the resin contained in the charge transport layer and the content of the siloxane moiety are shown in Table 9. Evaluation was performed as in Example 1. The results are shown in Table 12. Although a matrix-domain structure was formed in the resulting charge transport layer, domains were large and non-uniform.

Comparative Examples 37 and 38

Electrophotographic photosensitive members were produced as in Example 54 except that the polycarbonate resin A(15) in Example 1 was changed to a polycarbonate resin F(8) in which the example of the repeating structural unit (A-2) was changed to the formula (A-13) below and changes shown in Table 9 were made. The composition of the resin contained in the charge transport layer and the content of the siloxane moiety are shown in Table 9. Evaluation was performed as in Example 1. The results are shown in Table 12. A matrix-domain structure was not confirmed in the resulting charge transport layer. Note that the numerical value indicating the number of repetitions of the siloxane moiety in the repeating structural unit represented by the formula (A-13) below shows the average value of the number of repetitions. In this case, in the resin F(8), the average value of the number of repetitions of the siloxane moiety in the repeating structural unit represented by the formula (A-13) is 10.

(A-13)

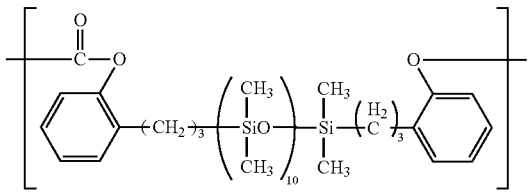

Comparative Examples 39 and 40

Electrophotographic photosensitive members were produced as in Example 54 except that the polycarbonate resin A(15) in Example 1 was changed to a polycarbonate resin F(9) in which the example of the repeating structural unit (A-2) was changed to the formula (A-14) below and changes shown in Table 9 were made. The composition of the resin contained in the charge transport layer and the content of the siloxane moiety are shown in Table 9. Evaluation was performed as in Example 1. The results are shown in Table 12. Although a matrix-domain structure was formed in the resulting charge transport layer, domains were large and non-uniform. Furthermore, as an electrophotographic photosensitive member, which was to be used as the control to obtain a relative value of torque, the control electrophotographic photosensitive member used in Example 1 was used. Note that the numerical value indicating the number of repetitions of the siloxane moiety in the repeating structural unit represented by the formula (A-14) below shows the average value of the number of repetitions. In this case, in the resin F(9), the average value of the number of repetitions of the siloxane moiety in the repeating structural unit represented by the formula (A-14) is 70.

(A-14)

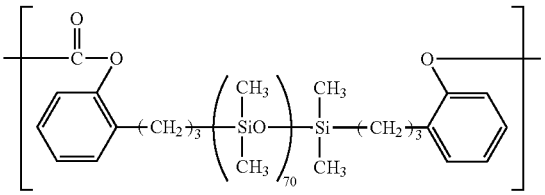

Comparative Examples 41 to 46

Electrophotographic photosensitive members were produced as in Example 1 except that the polycarbonate resin A(1) was changed to a resin (G(1): weight-average molecular weight 60,000) containing a repeating structural unit represented by the formula (G) below, which was a structure described in International Publication No. WO2010/008095, and the repeating structural unit represented by the formula (3) above, in which the content of the siloxane moiety in the resin was 30% by mass, and changes shown in Table 9 were made. In each of the repeating structural unit represented by the formula (G) and the repeating structural unit represented by the formula (3), the terephthalic acid/isophthalic acid ratio is 1/1. The composition of the resin contained in the charge transport layer and the content of the siloxane moiety are shown in Table 9. Evaluation was performed as in Example 1. The results are shown in Table 12. A matrix-domain structure was formed in the resulting charge transport layer. Furthermore, as an electrophotographic photosensitive member, which was to be used as the control to obtain a relative value of torque, the control electrophotographic photosensitive member used in Example 1 was used. Note that the numerical value indicating the number of repetitions of the siloxane moiety in the repeating structural unit represented by the formula (G) below shows the average value of the number of repetitions. In this case, in the resin G(1), the average value of the number of repetitions of the siloxane moiety in the repeating structural unit represented by the formula (G) below is 40.

(G)

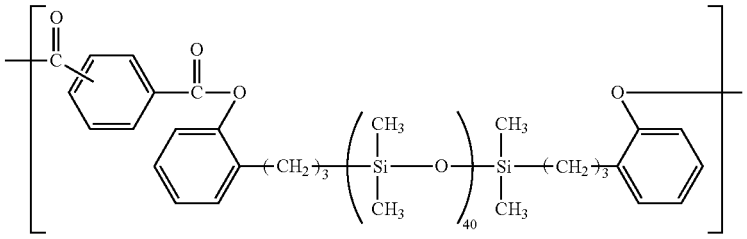

Comparative Examples 47 to 52

Electrophotographic photosensitive members were produced as in Example 54 except that the polycarbonate resin A(15) in Example 1 was changed to a polycarbonate resin F(10) in which the repeating structural unit represented by the formula (C) above was changed to the repeating structural unit represented by the formula (2-3) above and changes shown in Table 9 were made. The composition of the resin contained in the charge transport layer and the content of the siloxane moiety are shown in Table 9. Evaluation was performed as in Table 1. The results are shown in Table 12. A matrix-domain structure was not confirmed in the resulting charge transport layer.

Comparative Examples 53 to 55

Electrophotographic photosensitive members were produced as in Example 1 except that the components [α] and [β] and the charge-transporting substance were changed to those shown in Table 9, and evaluation was performed. The results are shown in Table 12. A matrix-domain structure was not confirmed in the resulting charge transport layer. Furthermore, the repeating structural units of the polycarbonate resin used as the component [β] are represented by the formulae (2-1) and (2-3) above and the formulae (2-5) and (2-6) below. In addition, the weight-average molecular weight of the polycarbonate resin used as the component [β] was as follows:

(2-3)/(2-5)=5/5: 70,000

(2-3)/(2-1)=8/2: 65,000

(2-6): 50,000

(2-5)

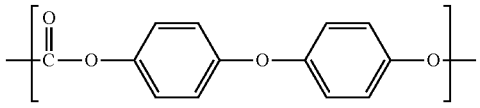

-continued (2-6)

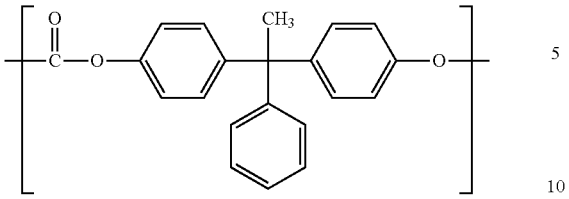

TABLE 5

| | Charge-transporting substance | Component [α] | Siloxane content A (mass %) | Component [β] | Mixing ratio between component [α] and component [β] | Siloxane content B (mass %) |
|---|---|---|---|---|---|---|
| Example 1 | (1-11)/(1-14) = 7/3 | Resin A(1) | 40 | (D) | 3/7 | 12 |
| Example 2 | (1-11)/(1-14) = 9/1 | Resin A(1) | 40 | (D) | 6/4 | 16 |
| Example 3 | (1-11)/(1-14) = 9/1 | Resin A(1) | 40 | (D) | 2/8 | 8 |
| Example 4 | (1-11)/(1-13) = 9/1 | Resin A(1) | 40 | (D) | 3/7 | 12 |
| Example 5 | (1-15) | Resin A(1) | 40 | (D) | 3/7 | 12 |
| Example 6 | (1-17) | Resin A(1) | 40 | (D) | 3/7 | 12 |
| Example 7 | (1-11)/(1-14) = 7/3 | Resin A(2) | 30 | (D) | 5/5 | 15 |
| Example 8 | (1-11)/(1-14) = 9/1 | Resin A(2) | 30 | (D) | 3/7 | 9 |
| Example 9 | (1-11)/(1-14) = 9/1 | Resin A(2) | 30 | (D) | 2/8 | 6 |
| Example 10 | (1-11)/(1-13) = 9/1 | Resin A(2) | 30 | (D) | 3/7 | 9 |
| Example 11 | (1-1) | Resin A(2) | 30 | (D) | 3/7 | 9 |
| Example 12 | (1-17) | Resin A(2) | 30 | (D) | 3/7 | 9 |
| Example 13 | (1-11)/(1-14) = 9/1 | Resin A(3) | 18 | (D) | 3/7 | 5 |
| Example 14 | (1-11)/(1-14) = 9/1 | Resin A(3) | 18 | (D) | 4/6 | 7 |
| Example 15 | (1-1) | Resin A(3) | 18 | (D) | 2/8 | 4 |
| Example 16 | (1-11)/(1-13) = 9/1 | Resin A(3) | 18 | (D) | 3/7 | 5 |
| Example 17 | (1-11)/(1-14) = 7/3 | Resin A(3) | 18 | (D) | 5/5 | 9 |
| Example 18 | (1-15) | Resin A(3) | 18 | (D) | 1/9 | 2 |
| Example 19 | (1-7)/(1-6) = 5/5 | Resin A(3) | 18 | (D) | 5/5 | 9 |
| Example 20 | (1-5) | Resin A(3) | 18 | (D) | 2/8 | 4 |
| Example 21 | (1-11)/(1-14) = 7/3 | Resin A(4) | 10 | (D) | 3/7 | 3 |
| Example 22 | (1-15) | Resin A(4) | 10 | (D) | 5/5 | 5 |
| Example 23 | (1-3) | Resin A(4) | 10 | (D) | 2/8 | 2 |
| Example 24 | (1-17) | Resin A(5) | 5 | (D) | 3/7 | 2 |
| Example 25 | (1-11)/(1-13) = 9/1 | Resin A(5) | 5 | (D) | 5/5 | 3 |
| Example 26 | (1-11)/(1-14) = 7/3 | Resin A(5) | 5 | (D) | 2/8 | 1 |
| Example 27 | (1-17) | Resin A(6) | 5 | (D) | 3/7 | 2 |
| Example 28 | (1-11)/(1-13) = 9/1 | Resin A(6) | 5 | (D) | 5/5 | 3 |
| Example 29 | (1-11)/(1-14) = 7/3 | Resin A(6) | 5 | (D) | 2/8 | 1 |
| Example 30 | (1-11)/(1-14) = 7/3 | Resin A(7) | 40 | (D) | 5/5 | 20 |
| Example 31 | (1-11)/(1-14) = 7/3 | Resin A(7) | 40 | (D) | 3/7 | 12 |
| Example 32 | (1-3) | Resin A(7) | 40 | (D) | 1/9 | 4 |
| Example 33 | (1-17) | Resin A(8) | 5 | (D) | 3/7 | 2 |
| Example 34 | (1-11)/(1-13) = 9/1 | Resin A(8) | 5 | (D) | 5/5 | 3 |
| Example 35 | (1-11)/(1-14) = 7/3 | Resin A(8) | 5 | (D) | 2/8 | 1 |
| Example 36 | (1-11)/(1-14) = 7/3 | Resin A(9) | 40 | (D) | 5/5 | 20 |
| Example 37 | (1-11)/(1-14) = 7/3 | Resin A(9) | 40 | (D) | 3/7 | 12 |
| Example 38 | (1-5) | Resin A(9) | 40 | (D) | 1/9 | 4 |
| Example 39 | (1-15) | Resin A(10) | 40 | (D) | 5/5 | 20 |
| Example 40 | (1-3) | Resin A(10) | 40 | (D) | 3/7 | 12 |
| Example 41 | (1-17) | Resin A(10) | 40 | (D) | 1/9 | 4 |
| Example 42 | (1-11)/(1-13) = 9/1 | Resin A(11) | 30 | (D) | 5/5 | 15 |
| Example 43 | (1-11)/(1-14) = 7/3 | Resin A(11) | 30 | (D) | 3/7 | 9 |
| Example 44 | (1-11)/(1-14) = 7/3 | Resin A(11) | 30 | (D) | 1/9 | 3 |
| Example 45 | (1-17) | Resin A(12) | 5 | (D) | 3/7 | 2 |
| Example 46 | (1-11)/(1-13) = 9/1 | Resin A(12) | 5 | (D) | 5/5 | 3 |
| Example 47 | (1-11)/(1-14) = 7/3 | Resin A(12) | 5 | (D) | 2/8 | 1 |
| Example 48 | (1-15) | Resin A(13) | 40 | (D) | 5/5 | 20 |
| Example 49 | (1-3) | Resin A(13) | 40 | (D) | 3/7 | 12 |
| Example 50 | (1-17) | Resin A(13) | 40 | (D) | 1/9 | 4 |

In Tables 5 to 8, the "charge-transporting substance" means the charge-transporting substance contained in the charge transport layer. In the case where charge-transporting substances were mixed for use, it means the types and mixing ratio of the charge-transporting substances. In Tables 5 to 8, the "component [α]" means the composition of the component [α]. In Tables 5 to 8, the "siloxane content A (mass %)" means the content of the siloxane moiety (mass %) in the polycarbonate resin A. In Tables 5 to 8, the "component [β]" means the composition of the component [β]. In Tables 5 to 8, the "mixing ratio between component [α] and component [β]" means the mixing ratio between the component [α] and the component [β] (component [α]/component [β]) in the charge transport layer. In Tables 5 to 8, the "siloxane content B (mass %)" means the content of the siloxane moiety (mass %) in the polycarbonate resin A relative to the total mass of the resin in the charge transport layer. In Table 8, the number of parts in the formulae (D) and (3) shown under the "component [β]" in Examples 171 to 187 indicate the amounts of resins mixed.

TABLE 6

| | Charge-transporting substance | Component [α] | Siloxane content A (mass %) | Component [β] | Mixing ratio between component [α] and component [β] | Siloxane content B (mass %) |
|---|---|---|---|---|---|---|
| Example 51 | (1-11)/(1-14) = 7/3 | Resin A(14) | 40 | (D) | 5/5 | 20 |
| Example 52 | (1-5) | Resin A(14) | 40 | (D) | 3/7 | 12 |
| Example 53 | (1-15) | Resin A(14) | 40 | (D) | 1/9 | 4 |
| Example 54 | (1-11)/(1-14) = 7/3 | Resin A(15) | 20 | (D) | 3/7 | 6 |
| Example 55 | (1-11)/(1-14) = 7/3 | Resin A(15) | 20 | (D) | 5/5 | 10 |
| Example 56 | (1-17) | Resin A(16) | 5 | (D) | 5/5 | 3 |
| Example 57 | (1-11)/(1-14) = 7/3 | Resin A(16) | 5 | (D) | 2/8 | 1 |
| Example 58 | (1-17) | Resin A(17) | 40 | (D) | 1/9 | 4 |
| Example 59 | (1-11)/(1-14) = 7/3 | Resin A(17) | 40 | (D) | 5/5 | 20 |
| Example 60 | (1-5) | Resin A(17) | 40 | (D) | 3/7 | 12 |
| Example 61 | (1-11)/(1-14) = 7/3 | Resin A(18) | 40 | (D) | 1/9 | 4 |
| Example 62 | (1-11)/(1-14) = 7/3 | Resin A(18) | 40 | (D) | 5/5 | 20 |
| Example 63 | (1-17) | Resin A(18) | 40 | (D) | 3/7 | 12 |
| Example 64 | (1-11)/(1-14) = 7/3 | Resin A(19) | 20 | (D) | 3/7 | 6 |
| Example 65 | (1-11)/(1-14) = 7/3 | Resin A(19) | 20 | (D) | 5/5 | 10 |
| Example 66 | (1-17) | Resin A(20) | 5 | (D) | 5/5 | 3 |
| Example 67 | (1-11)/(1-14) = 7/3 | Resin A(20) | 5 | (D) | 2/8 | 1 |
| Example 68 | (1-11)/(1-14) = 7/3 | Resin A(21) | 40 | (D) | 1/9 | 4 |
| Example 69 | (1-11)/(1-14) = 7/3 | Resin A(21) | 40 | (D) | 5/5 | 20 |
| Example 70 | (1-7)/(1-6) = 5/5 | Resin A(21) | 40 | (D) | 3/7 | 12 |
| Example 71 | (1-11)/(1-14) = 7/3 | Resin A(22) | 40 | (D) | 5/5 | 20 |
| Example 72 | (1-7)/(1-6) = 5/5 | Resin A(22) | 40 | (D) | 3/7 | 12 |
| Example 73 | (1-11)/(1-13) = 9/1 | Resin A(23) | 20 | (D) | 3/7 | 6 |
| Example 74 | (1-11)/(1-14) = 7/3 | Resin A(23) | 20 | (D) | 5/5 | 10 |
| Example 75 | (1-11)/(1-14) = 7/3 | Resin A(24) | 5 | (D) | 5/5 | 3 |
| Example 76 | (1-5) | Resin A(24) | 5 | (D) | 2/8 | 1 |
| Example 77 | (1-11)/(1-14) = 7/3 | Resin A(25) | 40 | (D) | 5/5 | 20 |
| Example 78 | (1-7)/(1-6) = 5/5 | Resin A(25) | 40 | (D) | 3/7 | 12 |
| Example 79 | (1-5) | Resin A(26) | 40 | (D) | 5/5 | 20 |
| Example 80 | (1-15) | Resin A(26) | 40 | (D) | 3/7 | 12 |
| Example 81 | (1-7)/(1-6) = 5/5 | Resin A(27) | 20 | (D) | 3/7 | 6 |
| Example 82 | (1-5) | Resin A(27) | 20 | (D) | 5/5 | 10 |
| Example 83 | (1-15) | Resin A(28) | 5 | (D) | 5/5 | 3 |
| Example 84 | (1-7)/(1-6) = 5/5 | Resin A(28) | 5 | (D) | 2/8 | 1 |
| Example 85 | (1-5) | Resin A(29) | 40 | (D) | 5/5 | 20 |
| Example 86 | (1-15) | Resin A(29) | 40 | (D) | 3/7 | 12 |
| Example 87 | (1-7)/(1-6) = 5/5 | Resin A(30) | 20 | (D) | 3/7 | 6 |
| Example 88 | (1-7)/(1-6) = 5/5 | Resin A(31) | 20 | (D) | 3/7 | 6 |
| Example 89 | (1-11)/(1-14) = 7/3 | Resin A(32) | 40 | (D) | 1/9 | 4 |
| Example 90 | (1-11)/(1-14) = 7/3 | Resin A(32) | 40 | (D) | 5/5 | 20 |
| Example 91 | (1-11)/(1-13) = 9/1 | Resin A(32) | 40 | (D) | 3/7 | 12 |
| Example 92 | (1-11)/(1-14) = 9/1 | Resin A(33) | 19 | (D) | 3/7 | 6 |
| Example 93 | (1-11)/(1-13) = 9/1 | Resin A(33) | 19 | (D) | 3/7 | 6 |
| Example 94 | (1-11)/(1-14) = 7/3 | Resin A(33) | 19 | (D) | 4/6 | 8 |
| Example 95 | (1-11)/(1-14) = 7/3 | Resin A(33) | 19 | (D) | 2/8 | 4 |
| Example 96 | (1-15) | Resin A(33) | 19 | (D) | 3/7 | 6 |
| Example 97 | (1-11)/(1-14) = 7/3 | Resin A(33) | 19 | (D) | 5/5 | 10 |
| Example 98 | (1-11)/(1-14) = 7/3 | Resin A(33) | 19 | (D) | 1/9 | 2 |
| Example 99 | (1-11)/(1-14) = 7/3 | Resin A(34) | 5 | (D) | 5/5 | 3 |
| Example 100 | (1-11)/(1-14) = 7/3 | Resin A(34) | 5 | (D) | 2/8 | 1 |

TABLE 7

| | Charge-transporting substance | Component [α] | Siloxane content A (mass %) | Component [β] | Mixing ratio between component [α] and component [β] | Siloxane content B (mass %) |
|---|---|---|---|---|---|---|
| Example 101 | (1-11)/(1-14) = 7/3 | Resin A(35) | 40 | (D) | 5/5 | 20 |
| Example 102 | (1-11)/(1-14) = 7/3 | Resin A(35) | 40 | (D) | 1/9 | 4 |
| Example 103 | (1-7)/(1-6) = 5/5 | Resin A(36) | 20 | (D) | 3/7 | 6 |
| Example 104 | (1-5) | Resin A(36) | 20 | (D) | 5/5 | 10 |
| Example 105 | (1-7)/(1-6) = 5/5 | Resin A(37) | 20 | (D) | 3/7 | 6 |
| Example 106 | (1-5) | Resin A(37) | 20 | (D) | 5/5 | 10 |
| Example 107 | (1-11)/(1-13) = 9/1 | Resin A(38) | 20 | (D) | 3/7 | 6 |
| Example 108 | (1-11)/(1-13) = 9/1 | Resin A(38) | 20 | (D) | 5/5 | 10 |
| Example 109 | (1-15) | Resin A(39) | 20 | (D) | 5/5 | 10 |
| Example 110 | (1-11)/(1-14) = 7/3 | Resin A(39) | 20 | (D) | 3/7 | 6 |
| Example 111 | (1-11)/(1-14) = 7/3 | Resin A(39) | 20 | (D) | 1/9 | 1 |
| Example 112 | (1-15) | Resin A(40) | 20 | (D) | 5/5 | 10 |

TABLE 7-continued

| | Charge-transporting substance | Component [α] | Siloxane content A (mass %) | Component [β] | Mixing ratio between component [α] and component [β] | Siloxane content B (mass %) |
|---|---|---|---|---|---|---|
| Example 113 | (1-11)/(1-14) = 7/3 | Resin A(40) | 20 | (D) | 3/7 | 6 |
| Example 114 | (1-11)/(1-14) = 7/3 | Resin A(40) | 20 | (D) | 1/9 | 1 |
| Example 115 | (1-7)/(1-6) = 5/5 | Resin A(3) | 18 | (D)/(2-3) = 5/5 | 5/5 | 9 |
| Example 116 | (1-7)/(1-6) = 5/5 | Resin A(3) | 18 | (D)/(2-3) = 5/5 | 3/7 | 5 |
| Example 117 | (1-7)/(1-6) = 5/5 | Resin A(7) | 40 | (D)/(2-3) = 5/5 | 3/7 | 12 |
| Example 118 | (1-7)/(1-6) = 5/5 | Resin A(7) | 40 | (D)/(2-3) = 5/5 | 2/8 | 8 |
| Example 119 | (1-7)/(1-6) = 5/5 | Resin A(8) | 5 | (D)/(2-3) = 5/5 | 5/5 | 3 |
| Example 120 | (1-7)/(1-6) = 5/5 | Resin A(15) | 20 | (D)/(2-3) = 5/5 | 3/7 | 6 |
| Example 121 | (1-7)/(1-6) = 5/5 | Resin A(15) | 20 | (D)/(2-3) = 5/5 | 2/8 | 2 |
| Example 122 | (1-7)/(1-6) = 5/5 | Resin A(19) | 20 | (D)/(2-3) = 5/5 | 3/7 | 6 |
| Example 123 | (1-7)/(1-6) = 5/5 | Resin A(19) | 20 | (D)/(2-3) = 5/5 | 2/8 | 2 |
| Example 124 | (1-7)/(1-6) = 5/5 | Resin A(26) | 40 | (D)/(2-3) = 5/5 | 3/7 | 12 |
| Example 125 | (1-7)/(1-6) = 5/5 | Resin A(26) | 40 | (D)/(2-3) = 5/5 | 2/8 | 8 |
| Example 126 | (1-7)/(1-6) = 5/5 | Resin A(33) | 19 | (D)/(2-3) = 5/5 | 3/7 | 6 |
| Example 127 | (1-7)/(1-6) = 5/5 | Resin A(33) | 19 | (D)/(2-3) = 5/5 | 2/8 | 2 |
| Example 128 | (1-7)/(1-6) = 5/5 | Resin A(3) | 18 | (D)/(2-1) = 8/2 | 5/5 | 9 |
| Example 129 | (1-7)/(1-6) = 5/5 | Resin A(3) | 18 | (D)/(2-1) = 8/2 | 3/7 | 5 |
| Example 130 | (1-7)/(1-6) = 5/5 | Resin A(7) | 40 | (D)/(2-1) = 8/2 | 3/7 | 12 |
| Example 131 | (1-7)/(1-6) = 5/5 | Resin A(7) | 40 | (D)/(2-1) = 8/2 | 2/8 | 8 |
| Example 132 | (1-7)/(1-6) = 5/5 | Resin A(8) | 5 | (D)/(2-1) = 8/2 | 5/5 | 3 |
| Example 133 | (1-7)/(1-6) = 5/5 | Resin A(15) | 20 | (D)/(2-1) = 8/2 | 3/7 | 6 |
| Example 134 | (1-7)/(1-6) = 5/5 | Resin A(15) | 20 | (D)/(2-1) = 8/2 | 2/8 | 2 |
| Example 135 | (1-7)/(1-6) = 5/5 | Resin A(19) | 20 | (D)/(2-1) = 8/2 | 3/7 | 6 |
| Example 136 | (1-7)/(1-6) = 5/5 | Resin A(19) | 20 | (D)/(2-1) = 8/2 | 2/8 | 2 |
| Example 137 | (1-7)/(1-6) = 5/5 | Resin A(26) | 40 | (D)/(2-1) = 8/2 | 3/7 | 12 |
| Example 138 | (1-7)/(1-6) = 5/5 | Resin A(26) | 40 | (D)/(2-1) = 8/2 | 2/8 | 8 |
| Example 139 | (1-7)/(1-6) = 5/5 | Resin A(33) | 19 | (D)/(2-1) = 8/2 | 3/7 | 6 |
| Example 140 | (1-7)/(1-6) = 5/5 | Resin A(33) | 19 | (D)/(2-1) = 8/2 | 2/8 | 2 |
| Example 141 | (1-5) | Resin A(3) | 18 | (D)/(2-2) = 8/2 | 5/5 | 9 |
| Example 142 | (1-5) | Resin A(3) | 18 | (D)/(2-2) = 8/2 | 3/7 | 5 |
| Example 143 | (1-7)/(1-6) = 5/5 | Resin A(7) | 40 | (D)/(2-2) = 8/2 | 3/7 | 12 |
| Example 144 | (1-1) | Resin A(8) | 5 | (D)/(2-2) = 8/2 | 5/5 | 3 |
| Example 145 | (1-1) | Resin A(15) | 20 | (D)/(2-2) = 8/2 | 3/7 | 6 |
| Example 146 | (1-7)/(1-6) = 5/5 | Resin A(19) | 20 | (D)/(2-2) = 8/2 | 3/7 | 6 |
| Example 147 | (1-7)/(1-6) = 5/5 | Resin A(26) | 40 | (D)/(2-2) = 8/2 | 3/7 | 12 |
| Example 148 | (1-15) | Resin A(26) | 40 | (D)/(2-2) = 8/2 | 2/8 | 8 |
| Example 149 | (1-3) | Resin A(33) | 19 | (D)/(2-2) = 8/2 | 3/7 | 6 |
| Example 150 | (1-17) | Resin A(33) | 19 | (D)/(2-2) = 8/2 | 2/8 | 2 |

TABLE 8

| | Charge-transporting substance | Component [α] | Siloxane content A (mass %) | Component [β] | Mixing ratio between component [α] and component [β] | Siloxane content B (mass %) |
|---|---|---|---|---|---|---|
| Example 151 | (1-7)/(1-6) = 5/5 | Resin A(3) | 18 | (D)/(2-4) = 8/2 | 5/5 | 9 |
| Example 152 | (1-7)/(1-6) = 5/5 | Resin A(3) | 18 | (D)/(2-4) = 8/2 | 3/7 | 5 |
| Example 153 | (1-7)/(1-6) = 5/5 | Resin A(7) | 40 | (D)/(2-4) = 8/2 | 3/7 | 12 |
| Example 154 | (1-7)/(1-6) = 5/5 | Resin A(8) | 5 | (D)/(2-4) = 8/2 | 5/5 | 3 |
| Example 155 | (1-7)/(1-6) = 5/5 | Resin A(15) | 20 | (D)/(2-4) = 8/2 | 3/7 | 6 |
| Example 156 | (1-7)/(1-6) = 5/5 | Resin A(19) | 20 | (D)/(2-4) = 8/2 | 3/7 | 6 |
| Example 157 | (1-7)/(1-6) = 5/5 | Resin A(26) | 40 | (D)/(2-4) = 8/2 | 3/7 | 12 |
| Example 158 | (1-7)/(1-6) = 5/5 | Resin A(26) | 40 | (D)/(2-4) = 8/2 | 2/8 | 8 |
| Example 159 | (1-7)/(1-6) = 5/5 | Resin A(33) | 19 | (D)/(2-4) = 8/2 | 3/7 | 6 |
| Example 160 | (1-7)/(1-6) = 5/5 | Resin A(33) | 19 | (D)/(2-4) = 8/2 | 2/8 | 2 |
| Example 161 | (1-7)/(1-6) = 5/5 | Resin A(3) | 18 | (D)/(2-1)/(2-4) = 6/2/2 | 5/5 | 9 |
| Example 162 | (1-7)/(1-6) = 5/5 | Resin A(3) | 18 | (D)/(2-1)/(2-4) = 6/2/2 | 3/7 | 5 |
| Example 163 | (1-7)/(1-6) = 5/5 | Resin A(7) | 40 | (D)/(2-1)/(2-4) = 6/2/2 | 3/7 | 12 |
| Example 164 | (1-7)/(1-6) = 5/5 | Resin A(8) | 5 | (D)/(2-1)/(2-4) = 6/2/2 | 5/5 | 3 |
| Example 165 | (1-7)/(1-6) = 5/5 | Resin A(15) | 20 | (D)/(2-1)/(2-4) = 6/2/2 | 3/7 | 6 |
| Example 166 | (1-7)/(1-6) = 5/5 | Resin A(19) | 20 | (D)/(2-1)/(2-4) = 6/2/2 | 3/7 | 6 |
| Example 167 | (1-7)/(1-6) = 5/5 | Resin A(26) | 40 | (D)/(2-1)/(2-4) = 6/2/2 | 3/7 | 12 |
| Example 168 | (1-7)/(1-6) = 5/5 | Resin A(26) | 40 | (D)/(2-1)/(2-4) = 6/2/2 | 2/8 | 8 |
| Example 169 | (1-7)/(1-6) = 5/5 | Resin A(33) | 19 | (D)/(2-1)/(2-4) = 6/2/2 | 3/7 | 6 |
| Example 170 | (1-7)/(1-6) = 5/5 | Resin A(33) | 19 | (D)/(2-1)/(2-4) = 6/2/2 | 2/8 | 2 |
| Example 171 | (1-11)/(1-14) = 9/1 | Resin A(3) | 18 | (D)9 parts, (3):1 part | 5/5 | 9 |
| Example 172 | (1-11)/(1-14) = 7/3 | Resin A(3) | 18 | (D)9 parts, (3):1 part | 3/7 | 5 |
| Example 173 | (1-11)/(1-14) = 9/1 | Resin A(7) | 40 | (D)9 parts, (3):1 part | 3/7 | 12 |
| Example 174 | (1-11)/(1-14) = 9/1 | Resin A(7) | 40 | (D)9 parts, (3):1 part | 2/8 | 8 |
| Example 175 | (1-11)/(1-13) = 9/1 | Resin A(8) | 5 | (D)9 parts, (3):1 part | 5/5 | 3 |

TABLE 8-continued

| | Charge-transporting substance | Component [α] | Siloxane content A (mass %) | Component [β] | Mixing ratio between component [α] and component [β] | Siloxane content B (mass %) |
|---|---|---|---|---|---|---|
| Example 176 | (1-11)/(1-14) = 9/1 | Resin A(15) | 20 | (D)9 parts, (3):1 part | 3/7 | 6 |
| Example 177 | (1-11)/(1-14) = 7/3 | Resin A(15) | 20 | (D)9 parts, (3):1 part | 2/8 | 2 |
| Example 178 | (1-11)/(1-14) = 9/1 | Resin A(19) | 20 | (D)9 parts, (3):1 part | 3/7 | 6 |
| Example 179 | (1-11)/(1-14) = 9/1 | Resin A(19) | 20 | (D)9 parts, (3):1 part | 2/8 | 2 |
| Example 180 | (1-11)/(1-14) = 9/1 | Resin A(26) | 40 | (D)9 parts, (3):1 part | 3/7 | 12 |
| Example 181 | (1-11)/(1-14) = 9/1 | Resin A(26) | 40 | (D)9 parts, (3):1 part | 2/8 | 8 |
| Example 182 | (1-11)/(1-14) = 9/1 | Resin A(33) | 19 | (D)9 parts, (3):1 part | 3/7 | 6 |
| Example 183 | (1-11)/(1-14) = 7/3 | Resin A(33) | 19 | (D)9 parts, (3):1 part | 2/8 | 2 |
| Example 184 | (1-11)/(1-14) = 7/3 | Resin A(32) | 40 | (D)9 parts, (3):1 part | 3/7 | 12 |
| Example 185 | (1-11)/(1-14) = 9/1 | Resin A(34) | 5 | (D)9 parts, (3):1 part | 5/5 | 3 |
| Example 186 | (1-11)/(1-13) = 9/1 | Resin A(33) | 19 | (D)9 parts, (3):1 part | 3/7 | 6 |
| Example 187 | (1-11)/(1-14) = 7/3 | Resin A(33) | 19 | (D)9 parts, (3):1 part | 2/8 | 2 |

TABLE 9

| | Charge-transporting substance | Resin | Siloxane content A (mass %) | Component [β] | Mixing ratio between resin F and component [β] | Siloxane content B (mass %) |
|---|---|---|---|---|---|---|
| Comparative Example 1 | (1-17) | Resin F(1) | 2 | (D) | 3/7 | 0.6 |
| Comparative Example 2 | (1-7)/(1-6) = 5/5 | Resin F(1) | 2 | (D)/(2-1) = 8/2 | 3/7 | 0.6 |
| Comparative Example 3 | (1-1) | Resin F(1) | 2 | (D)9 parts, (3):1 part | 3/7 | 0.6 |
| Comparative Example 4 | (1-17) | Resin F(1) | 2 | (D) | 5/5 | 1 |
| Comparative Example 5 | (1-7)/(1-6) = 5/5 | Resin F(1) | 2 | (D)/(2-1) = 8/2 | 5/5 | 1 |
| Comparative Example 6 | (1-1) | Resin F(1) | 2 | (D)9 parts, (3):1 part | 5/5 | 1 |
| Comparative Example 7 | (1-7)/(1-6) = 5/5 | Resin F(1) | 2 | — | — | 2 |
| Comparative Example 8 | (1-17) | Resin F(2) | 50 | (D) | 3/7 | 15 |
| Comparative Example 9 | (1-7)/(1-6) = 5/5 | Resin F(2) | 50 | (D)/(2-1) = 8/2 | 3/7 | 15 |
| Comparative Example 10 | (1-1) | Resin F(2) | 50 | (D)9 parts, (3):1 part | 3/7 | 15 |
| Comparative Example 11 | (1-17) | Resin F(2) | 50 | (D) | 1/9 | 5 |
| Comparative Example 12 | (1-7)/(1-6) = 5/5 | Resin F(2) | 50 | (D)/(2-1) = 8/2 | 1/9 | 5 |
| Comparative Example 13 | (1-1) | Resin F(2) | 50 | (D)9 parts, (3):1 part | 1/9 | 5 |
| Comparative Example 14 | (1-7)/(1-6) = 5/5 | Resin F(2) | 50 | — | — | 50 |
| Comparative Example 15 | (1-16) | Resin F(3) | 20 | (D) | 3/7 | 6 |
| Comparative Example 16 | (1-7)/(1-6) = 5/5 | Resin F(3) | 20 | (D)/(2-1) = 8/2 | 3/7 | 6 |
| Comparative Example 17 | (1-7)/(1-6) = 5/5 | Resin F(3) | 20 | (D)9 parts, (3):1 part | 3/7 | 6 |
| Comparative Example 18 | (1-7)/(1-6) = 5/5 | Resin F(3) | 20 | (D) | 5/5 | 10 |
| Comparative Example 19 | (1-17) | Resin F(3) | 20 | (D)/(2-1) = 8/2 | 5/5 | 10 |
| Comparative Example 20 | (1-7)/(1-6) = 5/5 | Resin F(3) | 20 | (D)9 parts, (3):1 part | 5/5 | 10 |
| Comparative Example 21 | (1-16) | Resin F(4) | 20 | (D) | 3/7 | 6 |
| Comparative Example 22 | (1-7)/(1-6) = 5/5 | Resin F(4) | 20 | (D)/(2-1) = 8/2 | 3/7 | 6 |
| Comparative Example 23 | (1-7)/(1-6) = 5/5 | Resin F(4) | 20 | (D)9 parts, (3):1 part | 3/7 | 6 |
| Comparative Example 24 | (1-7)/(1-6) = 5/5 | Resin F(4) | 20 | (D) | 5/5 | 10 |
| Comparative Example 25 | (1-17) | Resin F(4) | 20 | (D)/(2-1) = 8/2 | 5/5 | 10 |
| Comparative Example 26 | (1-7)/(1-6) = 5/5 | Resin F(4) | 20 | (D)9 parts, (3):1 part | 5/5 | 10 |
| Comparative Example 27 | (1-17) | Resin F(5) | 20 | (D) | 3/7 | 6 |
| Comparative Example 28 | (1-1) | Resin F(5) | 20 | (D) | 5/5 | 10 |
| Comparative Example 29 | (1-17) | Resin F(6) | 20 | (D) | 3/7 | 6 |
| Comparative Example 30 | (1-1) | Resin F(6) | 20 | (D) | 5/5 | 10 |
| Comparative Example 31 | (1-16) | Resin F(7) | 20 | (D) | 3/7 | 6 |
| Comparative Example 32 | (1-7)/(1-6) = 5/5 | Resin F(7) | 20 | (D)/(2-1) = 8/2 | 3/7 | 6 |
| Comparative Example 33 | (1-7)/(1-6) = 5/5 | Resin F(7) | 20 | (D)9 parts, (3):1 part | 3/7 | 6 |
| Comparative Example 34 | (1-14) | Resin F(7) | 20 | (D) | 5/5 | 10 |
| Comparative Example 35 | (1-17) | Resin F(7) | 20 | (D)/(2-1) = 8/2 | 5/5 | 10 |
| Comparative Example 36 | (1-7)/(1-6) = 5/5 | Resin F(7) | 20 | (D)9 parts, (3):1 part | 5/5 | 10 |
| Comparative Example 37 | (1-17) | Resin F(8) | 20 | (D) | 3/7 | 6 |
| Comparative Example 38 | (1-1) | Resin F(8) | 20 | (D) | 5/5 | 10 |
| Comparative Example 39 | (1-17) | Resin F(9) | 20 | (D) | 3/7 | 6 |
| Comparative Example 40 | (1-3) | Resin F(9) | 20 | (D) | 5/5 | 10 |
| Comparative Example 41 | (1-14) | Resin G | 30 | (D) | 3/7 | 9 |
| Comparative Example 42 | (1-14) | Resin G | 30 | (D)/(2-1) = 8/2 | 3/7 | 9 |
| Comparative Example 43 | (1-14) | Resin G | 30 | (D)9 parts, (3):1 part | 3/7 | 9 |
| Comparative Example 44 | (1-14) | Resin G | 30 | (D) | 5/5 | 15 |
| Comparative Example 45 | (1-14) | Resin G | 30 | (D)/(2-1) = 8/2 | 5/5 | 15 |
| Comparative Example 46 | (1-14) | Resin G | 30 | (D)9 parts, (3):1 part | 5/5 | 15 |
| Comparative Example 47 | (1-14) | Resin F(10) | 20 | (D) | 3/7 | 6 |
| Comparative Example 48 | (1-7)/(1-6) = 5/5 | Resin F(10) | 20 | (D)/(2-1) = 8/2 | 3/7 | 6 |
| Comparative Example 49 | (1-7)/(1-6) = 5/5 | Resin F(10) | 20 | (D)9 parts, (3):1 part | 3/7 | 6 |
| Comparative Example 50 | (1-14) | Resin F(10) | 20 | (D) | 5/5 | 10 |
| Comparative Example 51 | (1-7)/(1-6) = 5/5 | Resin F(10) | 20 | (D)/(2-1) = 8/2 | 5/5 | 10 |
| Comparative Example 52 | (1-7)/(1-6) = 5/5 | Resin F(10) | 20 | (D)9 parts, (3):1 part | 5/5 | 10 |

TABLE 9-continued

| | Charge-transporting substance | Resin | Siloxane content A (mass %) | Component [β] | Mixing ratio between resin F and component [β] | Siloxane content B (mass %) |
|---|---|---|---|---|---|---|
| Comparative Example 53 | (1-7)/(1-6) = 5/5 | Resin A(15) | 20 | (2-3)/(2-5) = 5/5 | 5/5 | 10 |
| Comparative Example 54 | (1-7)/(1-6) = 5/5 | Resin A(15) | 20 | (2-3)/(2-1) = 8/2 | 5/5 | 10 |
| Comparative Example 55 | (1-7)/(1-6) = 5/5 | Resin A(15) | 20 | (2-6) | 5/5 | 10 |

In Table 9, the "charge-transporting substance" means the charge-transporting substance contained in the charge transport layer. In the case where charge-transporting substances were used in mixture, it means the types and mixing ratio of the charge-transporting substances. In Table 9, the "resin F" means the resin F having the siloxane moiety. In Table 9, the "siloxane content A (mass %)" means the content of the siloxane moiety (mass %) in the "resin F". In Table 9, the "component [β]" means the composition of the component [β]. In Table 9, the "mixing ratio between resin F and component [β]" means the mixing ratio between the resin F or the polycarbonate resin A and the component [β] (resin F/component [β]) in the charge transport layer. In Table 9, the "siloxane content B (mass %)" means the content of the siloxane moiety (mass %) in the "resin F" relative to the total mass of all the resins in the charge transport layer.

TABLE 10

| | Potential variation (V) | Relative value of initial torque | Relative value of torque after 3,000 sheets | Particle size (nm) |
|---|---|---|---|---|
| Example 1 | 15 | 0.58 | 0.61 | 450 |
| Example 2 | 15 | 0.55 | 0.62 | 480 |
| Example 3 | 18 | 0.58 | 0.63 | 440 |
| Example 4 | 20 | 0.57 | 0.61 | 430 |
| Example 5 | 17 | 0.60 | 0.62 | 430 |
| Example 6 | 19 | 0.55 | 0.59 | 450 |
| Example 7 | 16 | 0.62 | 0.68 | 430 |
| Example 8 | 19 | 0.61 | 0.68 | 420 |
| Example 9 | 22 | 060 | 0.65 | 410 |
| Example 10 | 21 | 0.58 | 0.66 | 420 |
| Example 11 | 22 | 0.62 | 0.63 | 430 |
| Example 12 | 20 | 0.64 | 0.65 | 410 |
| Example 13 | 13 | 0.66 | 0.70 | 320 |
| Example 14 | 15 | 0.60 | 0.64 | 310 |
| Example 15 | 12 | 0.62 | 0.64 | 280 |
| Example 16 | 15 | 0.61 | 0.65 | 290 |
| Example 17 | 14 | 0.61 | 0.63 | 300 |
| Example 18 | 14 | 0.62 | 0.67 | 310 |
| Example 19 | 16 | 0.64 | 0.68 | 320 |
| Example 20 | 12 | 0.62 | 0.69 | 330 |
| Example 21 | 15 | 0.65 | 0.77 | 410 |
| Example 22 | 18 | 0.66 | 0.90 | 420 |
| Example 23 | 20 | 0.64 | 0.78 | 460 |
| Example 24 | 21 | 0.77 | 0.75 | 450 |
| Example 25 | 19 | 0.78 | 0.81 | 300 |
| Example 26 | 18 | 0.77 | 0.81 | 380 |
| Example 27 | 21 | 0.78 | 0.80 | 390 |
| Example 28 | 20 | 0.77 | 0.79 | 320 |
| Example 29 | 21 | 0.76 | 0.81 | 310 |
| Example 30 | 19 | 0.61 | 0.66 | 450 |
| Example 31 | 19 | 0.63 | 0.67 | 440 |
| Example 32 | 22 | 0.63 | 0.70 | 440 |
| Example 33 | 22 | 0.69 | 0.68 | 360 |
| Example 34 | 23 | 0.72 | 0.75 | 310 |
| Example 35 | 23 | 0.71 | 0.74 | 320 |
| Example 36 | 20 | 0.66 | 0.71 | 440 |
| Example 37 | 19 | 0.62 | 0.66 | 420 |
| Example 38 | 18 | 0.65 | 0.68 | 400 |
| Example 39 | 18 | 0.63 | 068 | 380 |
| Example 40 | 20 | 0.61 | 0.71 | 360 |
| Example 41 | 20 | 0.66 | 0.77 | 350 |

TABLE 10-continued

| | Potential variation (V) | Relative value of initial torque | Relative value of torque after 3,000 sheets | Particle size (nm) |
|---|---|---|---|---|
| Example 42 | 22 | 0.67 | 0.69 | 340 |
| Example 43 | 22 | 0.63 | 0.70 | 330 |
| Example 44 | 21 | 0.62 | 0.62 | 340 |
| Example 45 | 20 | 0.77 | 0.80 | 310 |
| Example 46 | 21 | 0.78 | 0.80 | 320 |
| Example 47 | 20 | 0.80 | 0.81 | 330 |
| Example 48 | 25 | 0.67 | 0.68 | 430 |
| Example 49 | 26 | 0.68 | 0.69 | 440 |
| Example 50 | 24 | 0.64 | 0.70 | 450 |
| Example 51 | 18 | 0.63 | 0.66 | 450 |
| Example 52 | 20 | 0.65 | 0.68 | 420 |
| Example 53 | 19 | 0.64 | 0.68 | 360 |
| Example 54 | 21 | 0.71 | 0.75 | 380 |
| Example 55 | 22 | 0.77 | 0.81 | 330 |
| Example 56 | 21 | 0.72 | 0.75 | 330 |
| Example 57 | 20 | 0.82 | 0.77 | 350 |
| Example 58 | 21 | 0.88 | 0.90 | 420 |
| Example 59 | 22 | 0.77 | 0.78 | 450 |
| Example 60 | 25 | 0.63 | 0.63 | 500 |
| Example 61 | 24 | 0.68 | 0.69 | 380 |
| Example 62 | 24 | 0.66 | 0.65 | 370 |
| Example 63 | 21 | 0.71 | 0.69 | 420 |
| Example 64 | 23 | 0.68 | 0.72 | 420 |
| Example 65 | 22 | 0.65 | 0.68 | 400 |
| Example 66 | 22 | 0.61 | 0.66 | 410 |
| Example 67 | 21 | 0.63 | 0.67 | 410 |
| Example 68 | 22 | 0.63 | 0.70 | 390 |
| Example 69 | 25 | 0.69 | 0.68 | 370 |
| Example 70 | 25 | 0.63 | 0.66 | 360 |
| Example 71 | 21 | 0.65 | 0.69 | 420 |
| Example 72 | 21 | 0.71 | 0.72 | 400 |
| Example 73 | 25 | 0.88 | 0.89 | 420 |
| Example 74 | 18 | 0.61 | 0.64 | 410 |
| Example 75 | 17 | 0.72 | 0.69 | 410 |
| Example 76 | 18 | 0.65 | 0.66 | 380 |
| Example 77 | 21 | 0.71 | 0.69 | 390 |
| Example 78 | 25 | 0.66 | 0.68 | 400 |
| Example 79 | 22 | 0.64 | 0.72 | 370 |
| Example 80 | 18 | 0.54 | 0.68 | 400 |
| Example 81 | 19 | 0.61 | 0.66 | 360 |
| Example 82 | 20 | 0.62 | 0.67 | 380 |
| Example 83 | 20 | 0.66 | 0.70 | 360 |
| Example 84 | 22 | 0.64 | 0.68 | 400 |
| Example 85 | 23 | 0.63 | 0.66 | 450 |
| Example 86 | 23 | 0.66 | 0.68 | 410 |
| Example 87 | 24 | 0.65 | 0.67 | 430 |
| Example 88 | 20 | 0.62 | 0.68 | 400 |
| Example 89 | 12 | 0.41 | 0.58 | 280 |
| Example 90 | 10 | 0.42 | 0.57 | 240 |
| Example 91 | 11 | 0.44 | 0.55 | 260 |
| Example 92 | 9 | 0.33 | 0.54 | 220 |
| Example 93 | 8 | 0.35 | 0.51 | 200 |
| Example 94 | 8 | 0.35 | 0.53 | 220 |
| Example 95 | 9 | 0.38 | 0.52 | 250 |
| Example 96 | 8 | 0.37 | 0.54 | 240 |
| Example 97 | 7 | 0.37 | 0.53 | 240 |
| Example 98 | 7 | 0.41 | 0.55 | 260 |
| Example 99 | 11 | 0.41 | 0.55 | 250 |
| Example 100 | 8 | 0.38 | 0.56 | 240 |

In Tables 10 to 12, the "particle size" means the number-average particle size of domains.

TABLE 11

| | Potential variation (V) | Relative value of initial torque | Relative value of torque after 3,000 sheets | Particle size (nm) |
|---|---|---|---|---|
| Example 101 | 7 | 0.41 | 0.54 | 240 |
| Example 102 | 12 | 0.42 | 0.55 | 260 |
| Example 103 | 10 | 0.39 | 0.58 | 250 |
| Example 104 | 10 | 0.42 | 0.60 | 260 |
| Example 105 | 8 | 0.44 | 0.58 | 270 |
| Example 106 | 7 | 0.48 | 0.60 | 220 |
| Example 107 | 8 | 0.46 | 0.61 | 230 |
| Example 108 | 8 | 0.45 | 0.62 | 240 |
| Example 109 | 28 | 0.58 | 0.71 | 400 |
| Example 110 | 24 | 0.55 | 0.65 | 380 |
| Example 111 | 25 | 0.59 | 0.69 | 350 |
| Example 112 | 28 | 0.60 | 0.72 | 340 |
| Example 113 | 26 | 0.55 | 0.72 | 360 |
| Example 114 | 29 | 0.54 | 0.66 | 350 |
| Example 115 | 22 | 0.75 | 0.75 | 420 |
| Example 116 | 25 | 0.68 | 0.72 | 380 |
| Example 117 | 25 | 0.70 | 0.72 | 410 |
| Example 118 | 27 | 0.78 | 0.75 | 390 |
| Example 119 | 22 | 0.79 | 0.76 | 380 |
| Example 120 | 25 | 0.77 | 0.79 | 380 |
| Example 121 | 25 | 0.78 | 0.79 | 410 |
| Example 122 | 22 | 0.75 | 0.76 | 400 |
| Example 123 | 26 | 0.76 | 0.77 | 400 |
| Example 124 | 25 | 0.77 | 0.79 | 400 |
| Example 125 | 24 | 0.75 | 0.80 | 430 |
| Example 126 | 23 | 0.73 | 0.76 | 420 |
| Example 127 | 23 | 0.74 | 0.76 | 450 |
| Example 128 | 25 | 0.77 | 0.78 | 440 |
| Example 129 | 24 | 0.75 | 0.76 | 420 |
| Example 130 | 22 | 0.76 | 0.79 | 400 |
| Example 131 | 22 | 0.74 | 0.77 | 410 |
| Example 132 | 25 | 0.76 | 0.78 | 410 |
| Example 133 | 25 | 0.75 | 0.80 | 410 |
| Example 134 | 21 | 0.76 | 0.77 | 420 |
| Example 135 | 21 | 0.75 | 0.76 | 380 |
| Example 136 | 23 | 0.75 | 0.76 | 400 |
| Example 137 | 23 | 0.76 | 0.77 | 420 |
| Example 138 | 25 | 0.76 | 0.79 | 390 |
| Example 139 | 24 | 0.77 | 0.78 | 350 |
| Example 140 | 24 | 0.76 | 0.77 | 400 |
| Example 141 | 26 | 0.75 | 0.76 | 380 |
| Example 142 | 22 | 0.75 | 0.76 | 400 |
| Example 143 | 24 | 0.76 | 0.77 | 420 |
| Example 144 | 21 | 0.76 | 0.77 | 380 |
| Example 145 | 24 | 0.73 | 0.75 | 370 |
| Example 146 | 25 | 0.71 | 0.73 | 380 |
| Example 147 | 24 | 0.73 | 0.75 | 380 |
| Example 148 | 21 | 0.71 | 0.76 | 420 |
| Example 149 | 21 | 0.70 | 0.71 | 400 |
| Example 150 | 25 | 0.72 | 0.77 | 410 |
| Example 151 | 24 | 0.68 | 0.71 | 330 |
| Example 152 | 25 | 0.71 | 0.72 | 390 |
| Example 153 | 21 | 0.77 | 0.77 | 350 |
| Example 154 | 23 | 0.71 | 0.73 | 340 |
| Example 155 | 24 | 0.68 | 0.72 | 340 |
| Example 156 | 25 | 0.66 | 0.73 | 380 |
| Example 157 | 24 | 0.68 | 0.70 | 370 |
| Example 158 | 22 | 0.68 | 0.75 | 400 |
| Example 159 | 23 | 0.67 | 0.77 | 410 |
| Example 160 | 23 | 0.66 | 0.74 | 420 |
| Example 161 | 24 | 0.65 | 0.73 | 400 |
| Example 162 | 21 | 0.71 | 0.74 | 420 |
| Example 163 | 22 | 0.66 | 0.72 | 420 |
| Example 164 | 27 | 0.65 | 0.73 | 400 |
| Example 165 | 21 | 0.70 | 0.74 | 400 |
| Example 166 | 22 | 0.70 | 0.76 | 390 |
| Example 167 | 26 | 0.72 | 0.77 | 380 |
| Example 168 | 25 | 0.72 | 0.76 | 410 |
| Example 169 | 26 | 0.72 | 0.74 | 430 |
| Example 170 | 24 | 0.73 | 0.73 | 420 |
| Example 171 | 12 | 0.60 | 0.68 | 280 |
| Example 172 | 12 | 0.66 | 0.68 | 270 |
| Example 173 | 11 | 0.61 | 0.70 | 280 |
| Example 174 | 13 | 0.60 | 0.65 | 240 |
| Example 175 | 11 | 0.60 | 0.66 | 290 |

TABLE 11-continued

| | Potential variation (V) | Relative value of initial torque | Relative value of torque after 3,000 sheets | Particle size (nm) |
|---|---|---|---|---|
| Example 176 | 10 | 0.58 | 0.59 | 300 |
| Example 177 | 11 | 0.54 | 0.62 | 240 |
| Example 178 | 12 | 0.51 | 0.66 | 260 |
| Example 179 | 13 | 0.66 | 0.67 | 250 |
| Example 180 | 10 | 0.61 | 0.68 | 270 |
| Example 181 | 12 | 0.62 | 0.66 | 260 |
| Example 182 | 7 | 0.34 | 0.57 | 200 |
| Example 183 | 8 | 0.34 | 0.54 | 210 |
| Example 184 | 8 | 0.33 | 0.56 | 220 |
| Example 185 | 7 | 0.38 | 0.55 | 250 |
| Example 186 | 6 | 0.37 | 0.51 | 240 |
| Example 187 | 5 | 0.42 | 0.55 | 250 |

TABLE 12

| | Potential variation (V) | Relative value of initial torque | Relative value of torque after 3,000 sheets | Particle size (nm) |
|---|---|---|---|---|
| Comparative Example 1 | 18 | 0.95 | 0.98 | — |
| Comparative Example 2 | 20 | 0.98 | 0.97 | — |
| Comparative Example 3 | 19 | 0.95 | 0.98 | — |
| Comparative Example 4 | 15 | 0.92 | 0.98 | — |
| Comparative Example 5 | 19 | 0.94 | 0.99 | — |
| Comparative Example 6 | 22 | 0.98 | 0.94 | — |
| Comparative Example 7 | 20 | 0.95 | 0.97 | — |
| Comparative Example 8 | 92 | 0.58 | 0.80 | 1000 |
| Comparative Example 9 | 90 | 0.63 | 0.83 | 1060 |
| Comparative Example 10 | 85 | 0.65 | 0.85 | 1020 |
| Comparative Example 11 | 80 | 0.64 | 0.84 | 1050 |
| Comparative Example 12 | 98 | 0.63 | 0.82 | 1080 |
| Comparative Example 13 | 102 | 0.65 | 0.82 | 950 |
| Comparative Example 14 | 55 | 0.95 | 0.96 | — |
| Comparative Example 15 | 42 | 0.88 | 0.97 | — |
| Comparative Example 16 | 56 | 0.87 | 0.94 | — |
| Comparative Example 17 | 50 | 0.90 | 0.95 | — |
| Comparative Example 18 | 45 | 0.91 | 0.94 | — |
| Comparative Example 19 | 53 | 0.89 | 0.96 | — |
| Comparative Example 20 | 50 | 0.92 | 0.98 | — |
| Comparative Example 21 | 140 | 0.68 | 0.78 | 1300 |
| Comparative Example 22 | 130 | 0.67 | 0.82 | 1200 |
| Comparative Example 23 | 145 | 0.68 | 0.83 | 1250 |
| Comparative Example 24 | 135 | 0.70 | 0.81 | 1350 |
| Comparative Example 25 | 150 | 0.72 | 0.82 | 1100 |
| Comparative Example 26 | 140 | 0.73 | 0.84 | 1150 |
| Comparative Example 27 | 70 | 0.81 | 0.95 | — |
| Comparative Example 28 | 81 | 0.85 | 0.99 | — |
| Comparative Example 29 | 91 | 0.88 | 0.97 | — |
| Comparative Example 30 | 120 | 0.90 | 0.95 | — |
| Comparative Example 31 | 110 | 0.87 | 0.96 | — |
| Comparative Example 32 | 97 | 0.85 | 0.97 | — |
| Comparative Example 33 | 102 | 0.88 | 0.96 | — |
| Comparative Example 34 | 95 | 0.90 | 0.97 | — |
| Comparative Example 35 | 105 | 0.88 | 0.98 | — |
| Comparative Example 36 | 90 | 0.90 | 0.97 | — |
| Comparative Example 37 | 22 | 0.78 | 0.83 | — |
| Comparative Example 38 | 25 | 0.71 | 0.80 | — |
| Comparative Example 39 | 81 | 0.61 | 0.75 | 720 |
| Comparative Example 40 | 91 | 0.58 | 0.75 | 870 |
| Comparative Example 41 | 48 | 0.68 | 0.79 | 500 |
| Comparative Example 42 | 51 | 0.68 | 0.78 | 490 |
| Comparative Example 43 | 55 | 0.67 | 0.72 | 480 |
| Comparative Example 44 | 49 | 0.70 | 0.75 | 510 |
| Comparative Example 45 | 52 | 0.70 | 0.75 | 500 |
| Comparative Example 46 | 55 | 0.69 | 0.72 | 520 |
| Comparative Example 47 | 75 | 0.91 | 0.98 | — |
| Comparative Example 48 | 66 | 0.88 | 0.99 | — |
| Comparative Example 49 | 68 | 0.93 | 0.96 | — |
| Comparative Example 50 | 71 | 0.94 | 0.97 | — |

TABLE 12-continued

| | Potential variation (V) | Relative value of initial torque | Relative value of torque after 3,000 sheets | Particle size (nm) |
|---|---|---|---|---|
| Comparative Example 51 | 76 | 0.91 | 0.98 | — |
| Comparative Example 52 | 77 | 0.95 | 0.99 | — |
| Comparative Example 53 | 66 | 0.82 | 0.92 | — |
| Comparative Example 54 | 68 | 0.83 | 0.96 | — |
| Comparative Example 55 | 76 | 0.84 | 0.97 | — |

Comparison between Examples and Comparative Examples 1 to 6 shows that, when the content of the siloxane moiety relative to the polycarbonate resin containing the siloxane moiety in the charge transport layer is low, a sufficient effect of reducing contact stress is not obtained. This is indicated by the fact that in the initial evaluation and evaluation after 3,000 sheets in the evaluation process, the effect of reducing torque is not exhibited. Furthermore, Comparative Example 7 shows that, when the content of the siloxane moiety relative to the polycarbonate resin having the siloxane moiety is low, even if the content of the siloxane-containing resin in the charge transport layer is increased, it is not possible to obtain a sufficient effect of reducing contact stress.

Comparison between Examples and Comparative Examples 8 to 13 shows that, when the content of the siloxane moiety relative to the polycarbonate resin containing the siloxane moiety in the charge transport layer is high, potential stability during repeated use is insufficient. In this case, although the matrix-domain structure due to the polycarbonate resin containing the siloxane moiety is formed, since an excessive amount of the siloxane structure is present in the polycarbonate resin or the charge transport layer, compatibility with the charge-transporting substance becomes insufficient. Therefore, a sufficient effect of potential stability during repeated use is not obtained. Furthermore, the results of Comparative Example 14 also show that potential stability during repeated use is insufficient. The results of Comparative Example 14 show that when a matrix-domain structure is not formed, a large potential variation occurs. That is, in Comparative Examples 8 to 14, when a charge-transporting substance and an excessive amount of the siloxane structure are contained in the resin, it is assumed that compatibility with the charge-transporting substance becomes insufficient.

Comparison between Examples and Comparative Examples 15 to 20 or Comparative Examples 27 to 36 shows that, when the content of the repeating structural unit represented by the formula (B) in the polycarbonate resin A which is the component [α] is low, a matrix-domain structure is not formed, and a sufficient effect of reducing contact stress is not obtained. This is indicated by the fact that in the initial evaluation and evaluation after 3,000 sheets in the evaluation process, the effect of reducing torque is not sufficient.

Comparison between Examples and Comparative Examples 21 to 26 show that when the content of the repeating structural unit represented by the formula (B) in the polycarbonate resin A is high, although the matrix-domain structure due to the polycarbonate resin A is formed, the effect of potential stability during repeated use is insufficient.

Comparison between Examples and Comparative Examples 37 to 40 shows that, when the repeating structural unit represented by the formula (A) in the polycarbonate resin A is out of the range according to aspects of the present invention, the effect of continuously reducing contact stress and potential stability during repeated use are not sufficiently achieved.

Comparison between Examples and Comparative Examples 41 to 46 shows that a high effect of continuously reducing contact stress is obtained in the structure according to aspects of the present invention compared with the case where the matrix-domain structure is formed using the polyester resin having the siloxane structure. This shows that by using the polycarbonate resin A according to aspects of the present invention, both potential stability during repeated use and continuous reduction of contact stress can be further achieved.

The reason for this is believed to be that, by incorporating the repeating structural unit represented by the formula (B) above in aspects of the present invention at a specific content, domains can be further refined and made uniform, and the matrix-domain structure is more distinctly formed in the charge transport layer. Furthermore, comparison between Examples and Comparative Examples 47 to 52 shows that, when the component [α] does not include the repeating structural unit represented by the formula (C), the effect of continuously reducing contact stress is not obtained sufficiently. This is indicated by the fact that in the initial evaluation and evaluation after 3,000 sheets in the evaluation process, the effect of reducing torque is not sufficient. Similarly, comparison between Examples and Comparative Examples 53 to 55 shows that, when the component [β] is not the repeating structural unit represented by the formula (D) above, the effect of continuously reducing contact stress is not obtained sufficiently. This is indicated by the fact that in the initial evaluation and evaluation after 3,000 sheets in the evaluation process, the effect of reducing torque is not sufficient.

According to aspects of the present invention, it is possible to provide an electrophotographic photosensitive member which is excellent in terms of both continuous reduction of contact stress with contact members and the like and potential stability during repeated use. Furthermore, according to aspects of the present invention, it is possible to provide a process cartridge and an electrophotographic apparatus each including the electrophotographic photosensitive member. Furthermore, according to aspects of the present invention, it is possible to provide a method of producing an electrophotographic photosensitive member in which the electrophotographic photosensitive member described above is produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2011/059248, filed Apr. 14, 2011, which is hereby incorporated by reference herein in its entirety.

The invention claimed is:

1. An electrophotographic photosensitive member comprising a support, a charge generation layer provided on the support, and a charge transport layer provided on the charge generation layer, the charge transport layer serving as a surface layer, the electrophotographic photosensitive member being characterized in that the charge transport layer has a matrix-domain structure including:

a matrix containing a component [β] described below and a charge-transporting substance, and domains containing a component [α] described below, wherein component [α] comprises a polycarbonate resin A which has a repeating structural unit represented by the formula (A) below, a repeating structural unit represented by the formula (B) below, and a repeating structural unit represented by the formula (C) below and in which the content of a siloxane moiety is 5% to 40% by mass, the content of the repeating structural unit represented by the formula (B) below is 10% to 30% by mass, and the content of the repeating structural unit represented by the formula (C) below is 25% to 85% by mass:

(A)

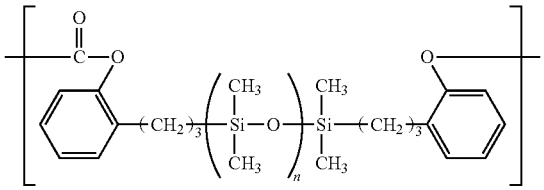

wherein in the formula (A), n represents the number of repetitions of a structure within the brackets, and the average value of n for the polycarbonate resin A is 20 to 60, (B)

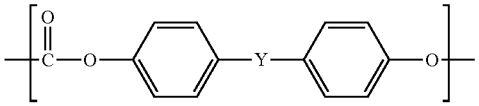

wherein in the formula (B), Y represents an oxygen atom or a sulfur atom, (C)

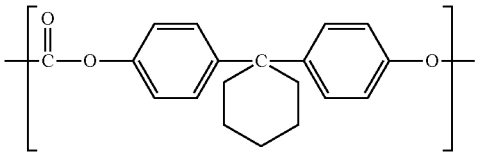

and wherein component [β] comprises a polycarbonate resin D which has a repeating structural unit represented by the formula (D) below:

(D)

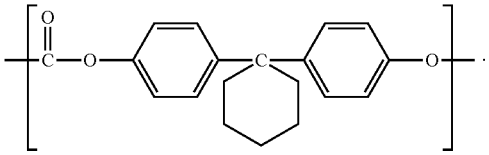

2. The electrophotographic photosensitive member according to claim 1, wherein the content of the siloxane moiety in the charge transport layer is 1% to 20% by mass relative to the total mass of all the resins in the charge transport layer.

3. A process cartridge characterized by integrally holding the electrophotographic photosensitive member according to claim 1 and at least one means selected from the group consisting of charging means, developing means, transferring means, and cleaning means, and by being detachably mountable to a main body of an electrophotographic apparatus.

4. An electrophotographic apparatus characterized by comprising the electrophotographic photosensitive member according to claim 1, charging means, exposing means, developing means, and transferring means.

5. A method of producing the electrophotographic photosensitive member according to claim 1, the method being characterized by comprising a step of applying a charge transport layer coating solution containing the components [α] and [β] and a charge-transporting substance onto the charge generation layer, followed by drying to form the charge transport layer.

6. The electrophotographic photosensitive member according to claim 1, wherein the charge-transporting substance is at least one selected from the group consisting of:

a compound having a structure represented by the formula (1a), a compound having a structure represented by the formula (1a'), a compound having a structure represented by the formula (1b), and a compound having a structure represented by the formula (1b'), (1a)

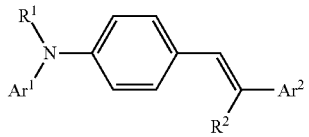

(1a')

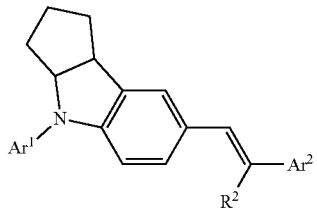

where, in the formulae (1a) and (1a'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula Ta represents an univalent group derived from a benzene ring of a triphenylamine by loss of one hydrogen atom, or derived from a benzene ring of a triphenylamine substituted with a methyl group or an ethyl group by loss of one hydrogen atom, $R^1$ represents a phenyl group, a phenyl group substituted with a methyl group, or a phenyl group substituted with an univalent group represented by the formula —CH═$(Ar^3)Ar^4$, $Ar^3$ and $Ar^4$ each independently represents a phenyl group or a phenyl group substituted with a methyl group, and $R^2$ represents a hydrogen atom, a phenyl group, or a phenyl group substituted with a methyl group, (1b)
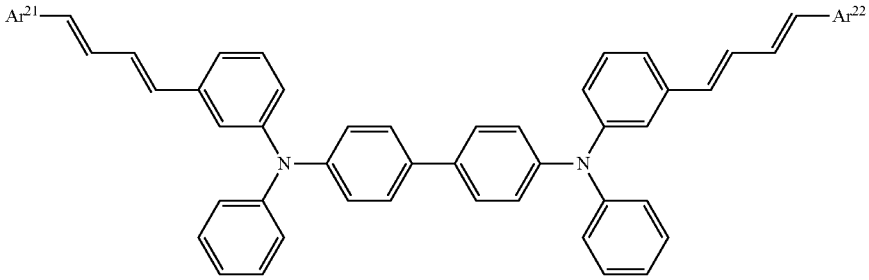
(1b')
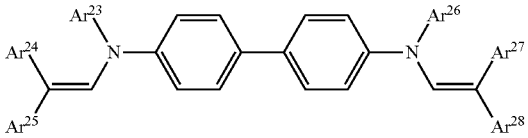
where, in the formulae (1b) and (1b'),
$Ar^{21}$ and $Ar^{22}$ each independently represent a phenyl group or a tolyl group,
$Ar^{23}$ and $Ar^{26}$ each independently represent a phenyl group, a phenyl group substituted with a methyl group, and
$Ar^{24}$, $Ar^{25}$, $Ar^{27}$, and $Ar^{28}$ each independently represent a phenyl group or a tolyl group.
* * * * *